United States Patent [19]

Saitou et al.

[11] Patent Number: 4,987,064

[45] Date of Patent: Jan. 22, 1991

[54] SILVER HALIDE PHOTOGRAPHIC MATERIALS

[75] Inventors: Mitsuo Saitou; Toshinao Ukai; Tadashi Ikeda, all of Kanagawa, Japan

[73] Assignee: Fuji Photo Film Co., Ltd., Kanagawa, Japan

[21] Appl. No.: 448,050

[22] Filed: Dec. 8, 1989

[30] Foreign Application Priority Data

Dec. 9, 1988 [JP] Japan ..... 63-311518
Jun. 7, 1989 [JP] Japan ..... 1-144724

[51] Int. Cl.[5] ..... G03C 1/10; G03C 1/34

[52] U.S. Cl. ..... 430/570; 430/578; 430/579; 430/580; 430/581; 430/583; 430/585; 430/588; 430/591; 430/592; 430/594; 430/595; 430/607; 430/613; 430/614; 430/611; 430/567

[58] Field of Search ..... 430/570, 578, 579, 580, 430/581, 583, 585, 588, 591, 592, 594, 595, 607, 613, 614, 611, 567

[56] References Cited

U.S. PATENT DOCUMENTS

| | | | |
|---|---|---|---|
| 4,040,825 | 8/1977 | Steiger et al. | 96/1.7 |
| 4,582,786 | 4/1986 | Ikeda et al. | 430/577 |
| 4,800,154 | 1/1989 | Okazaki et al. | 430/570 |
| 4,839,270 | 6/1989 | Kojima et al. | 430/583 |

*Primary Examiner*—Paul R. Michl
*Assistant Examiner*—Janis L. Dote
*Attorney, Agent, or Firm*—Sughrue, Mion, Zinn, Macpeak & Seas

[57] ABSTRACT

A silver halide photographic material is disclosed, comprising a support having thereon an emulsion layer comprising a dispersion medium, silver halide grains, and a pendant type sensitizing dye, wherein said pendant type sensitizing dye is a compound comprising a sensitizing dye and an antifoggant, each of which may have substituent groups and wherein said sensitizing dye and antifoggant are organochemically bonded.

15 Claims, 1 Drawing Sheet

SILVER HALIDE PHOTOGRAPHIC MATERIALS

FIELD OF THE INVENTION

This invention relates to silver halide (referred to hereinafter as AgX) emulsions which are useful in the field of photography, and photographic materials in which they are used. In particular, it relates to AgX emulsions comprised of at least dispersion media, pendant type spectrally sensitizing dyes and AgX grains, and to photographic materials in which these emulsions are used.

BACKGROUND OF THE INVENTION

Almost all AgX photographic materials normally contain spectrally sensitizing dyes (referred to hereinafter as sensitizing dyes) and antifoggants. The sensitizing dyes are used to extend the photosensitive wavelength region of the AgX from its intrinsic region to the long wavelength side (into the green, red, and infrared regions), and to increase photographic speed in the blue region. On the other hand, antifoggants are used to prevent the occurrence of fogging during the storage of the AgX photosensitive material (when they are known as emulsion stabilizers) and to prevent the occurrence of fogging during development (when they are known as development inhibitors). Both sensitizing dyes and antifoggants are therefore essential additives for AgX photographic emulsions. These additives are normally added using the following methods.

(i) Methods in which each additive is added individually. In some methods the total amount is added at one time, and in other methods the total amount is divided and added in several parts.

(ii) Methods in which the additives are mixed together prior to addition.

However, the following disadvantages arise when these additives are added using these conventional methods.

(1) Adsorption of the sensitizing dyes and antifoggants is competitive, and in some cases spectrally sensitizing dyes are desorbed and replaced by antifoggants while in other cases where the reverse is true. Accordingly, the most preferable spectrally sensitizing dyes and antifoggants for the photographic property can not be freely selected.

(2) In general, the adsorption of cyanine dyes on AgX is due principally to van der Waals forces and the strength of adsorption becomes weaker as the polarity of the substrate falls (in the order AgI→AgBr →AgCl). In the case of AgX emulsions which have a high chloride ion ($Cl^-$) content in the grain surface, the strength of adsorption of sensitizing dyes is particularly weak and there is a problem in that it has not been possible to realize the preferred spectral sensitization.

(3) Antifoggants can generally be represented in the form (HL) of an acid, and the antifoggant becomes more strongly adsorbed as, on comparing the solubility product pKsp (AgL)= $-\log [Ag^+]$ and the solubility product pKsp (AgX) for AgX, the difference [pKsp (AgL)−pKsp (AgX)] becomes greater. Accordingly, the strength of adsorption when using the same antifoggant will increase in the order AgI <AgBr <AgCl. This trend is the opposite of that observed in the case of the cyanine dyes and the undesirable reaction in which antifoggants desorb and replace cyanine dyes on AgX emulsions with a high Cl content referred to in (1) above is further advanced, and this is undesirable.

(4) In general, when cationic cyanine dyes are added to an AgX emulsion the state of adsorption changes from a state of single molecule type adsorption through a state in which aggregates of two or three molecules are adsorbed to a state in which larger aggregates are adsorbed as the adsorbed covering factor of the sensitizing dye increases, and there is an accompanying decrease in intrinsic speed and a reduction in color-sensitization efficiency. The following factors can be considered in connection with the decrease in speed.

a. A large local increase in the potential of the space charge layer occurs at the surface of an AgX grain in the locality of a cationic dye aggregate (since the cationic dye is adsorbed on the $X^-$ sites of the AgX crystal surface and the interstitial silver ion concentration is increased), and electron transfer from the sensitizing dye to the AgX layer is inhibited.

b. The interstitial silver ion concentration is increased in the vicinity of the said local surface, promoting latent image formation, and so the latent image is dispersed and the efficiency with which a developable latent image is formed is reduced.

c. Cationic dye aggregates on the AgX grain surface form a type of static potential with respect to the conductive electrons in the AgX grains and function as electron trap centers, reducing the latent image formation efficiency at the chemically sensitized nuclei.

d. Development inhibition is increased by the presence of large J-aggregates.

Control of the aggregate size is important since these undesirable effects normally become more pronounced as the said size increases. However, the sensitizing dye aggregate size increases in cases where sensitizing dyes and antifoggants have been added to an AgX emulsion and the most stable adsorption equilibrium has been established, and it is difficult to control the said size as desired. There are methods by which aggregate growth is stopped during growth, but this involves a metastable state and the stability is poor. Furthermore, there is no change in that the outcome is still uncertain. Hence there is a problem that it is not possible to adjust the sensitizing dyes to the most desirable state of adsorption from the photographic point of view.

(5) In cases where single molecules, aggregates of two or three molecules and aggregates of four or more molecules are all present in the state of adsorption of the dye as described in (4) above, the absorption spectral bands of these states will, in general, be different and so the overall spectral absorption band will be very wide. This is particularly undesirable in color photographic systems. This is because, in a color photographic system, the absorption spectra of each of the blue, green and red photosensitive layers should not extend to any great extent into the other color sensitive layer regions from the viewpoint of color reproduction. Hence a single adsorbed state and an absorption which has a narrow half value width is desirable, but at present it is not possible to achieve such control. There are many cases in which there are only J-aggregates and single molecules present, and in the region of saturated dye adsorption the dye will almost all be present as J-aggregates, but this region is often a region of reduced sensitivity and it cannot be used.

Hence, the discovery of AgX photographic materials in which at least one of the above mentioned problems (1) to (5) have been resolved is awaited.

SUMMARY OF THE INVENTION

The object of this invention is to provide AgX photographic materials which have photographic performance such that there has been an improvement in respect of at least one of the problems mentioned in (1) to (5) above.

The object of this invention has been achieved by a silver halide photographic material comprising at least one AgX emulsion comprising at least a dispersion medium, pendant type spectrally sensitizing dyes (referred to hereinafter as pendant type dyes and defined hereinbelow) and AgX grains.

DETAILED DESCRIPTION OF THE INVENTION

Figure 1:
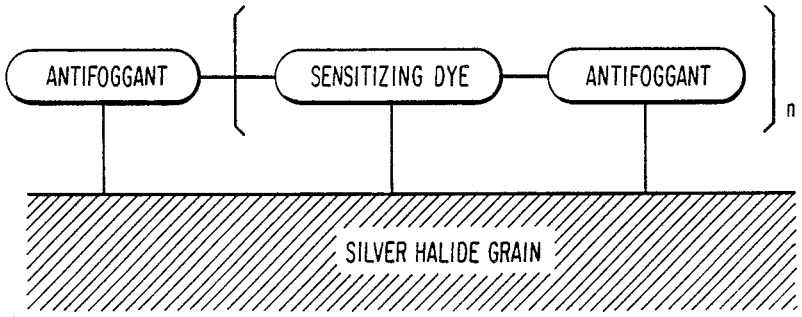
FIG. 1 shows the embodiment in which the sensitizing dye is coercively adsorbed on the silver halide grain by adsorbing the antifoggants of both sides of the sensitizing dye to the silver halide grain. n represents an integer of 1, 2 or 3.

The pendant dyes referred to herein are compounds in which at least a sensitizing dye and antifoggant are organochemically bonded, either directly via substituent groups, or via a linking agent, and some have been disclosed by the present inventors in JP-A-1-158425 (the term "JP-A" as used herein means an "unexamined published Japanese patent application").

Here, the "sensitizing dye" is a methine dye as generally used as a spectral sensitizer for AgX emulsions; for example, a cyanine dye, merocyanine dye, complex cyanine dye, complex merocyanine dye, holopolar cyanine dye, hemicyanine dye, styryl dye or hemioxonol dye, preferably a cyanine dye, a merocyanine dye or a rhodacyanine dye, and most preferably a cyanine dye.

"Cyanine dye" is a generic name for cationic dyes in which two nitrogen-containing heterocyclic rings are joined by a methine group, —CH=, one of the nitrogen atoms having a tertiary amine structure and the other having a quaternary ammonium structure, and the structural formulae can be represented by formula (1). These dyes are usually adsorbed on halogen ion sites on a AgX grain surface.

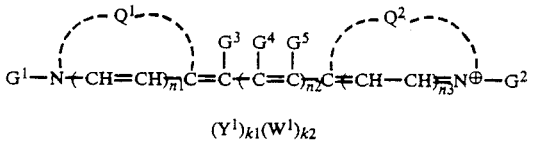

(1)

$(Y^1)_{k1}(W^1)_{k2}$ $Q^1$ and $Q^2$ may be the same or different, and each represents a group of atoms which is required to form a cyclic nucleus derived from a basic heterocyclic compound commonly used in cyanine dyes, such as oxazoline, oxazole, benzoxazole, naphthoxazole, thiazoline, thiazole, benzothiazole, naphthothiazole, dihydronaphthothiazole, selenazoline, selenazole, benzoselenazole, naphthoselenazole, 3H-indole, benzindole, imidazoline, imidazole, benzimidazole, naphthoimidazole, pyridine, quinoline, imidazo[4,5-b]quinoxaline, pyrrolidinetellurazole, benzotellurazole and naphthotellurazole for example. The above mentioned nuclei may have one or two or more types of ring substituent group (RO). Such substituent groups include, for example, hydroxyl groups, halogen atoms, lower alkyl groups and substituted alkyl groups, aryl groups and substituted aryl groups, lower alkoxy groups, or substituted alkoxy groups, aryloxy groups, lower alkylthio groups, arylthio groups, a methylenedioxy groups, cyano groups, amino groups and substituted amino groups, carboxyl groups, alkoxycarbonyl groups, and acyl groups.

$G^1$ and $G^2$ may be the same or different, each representing an alkyl group, aryl group, heterocyclic group or alkenyl group, and these may be unsubstituted or substituted groups.

$G^3$ is hydrogen or fluorine, but when $n^2$ is not 0, $G^3$ may also represent an alkyl group or substituted alkyl group. Furthermore, a 5- or 6-membered ring may be formed by alkylene crosslinking with $G^1$.

$G^4$ and $G^5$ represent hydrogen or unsubstituted or substituted lower alkyl groups or aryl groups, $n^1$ and $n^3$ are 0 or 1, and $n^2$ represents 0, 1, 2 or 3. $Y^1$ is a cationic group, $W^1$ is an anionic group, and $k^1$ and $k^2$ are 0 or 1, depending on the presence of absence of ionic substituent groups. Furthermore, $G^3$ and $G^5$, $G^4$ and $G^4$ (when $n^2$ is 2 or 3), $G^5$ and $G^5$ (when $n^2$ is 2 or 3), and $G^2$ and $G^5$, can also represent the atoms necessary to complete 5- or 6-membered rings, which may be alkylene-crosslinked and may contain oxygen atoms or nitrogen atoms in a ring.

Merocyanine dyes are non-ionic dyes which can be represented by formula (2) and they are normally adsorbed on $Ag^+$ sites on the AgX grain surface.

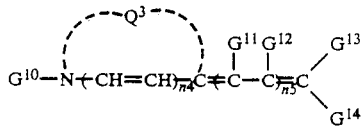

(2)

$Q^3$ has the same signification as either $Q^1$ or $Q^2$ in the aforementioned formula (I), $G^{10}$ has the same signification as either $G^1$ or $G^2$ in the aforementioned formula (1), and $G^{11}$ and $G^{12}$ represent hydrogen, substituted or unsubstituted lower alkyl groups, aryl groups or halogen atoms. Any two groups selected from $G^{10}$, $G^{11}$ and $G^{12}$ can represent the elements required to complete an alkylene crosslink.

$G^{13}$ and $G^{14}$ may be the same or different, each representing an electron attractive group. For example, they may be cyano groups, alkyl or aryl sulfonyl groups, carboxyl groups, alkyl or aryl carbonyl groups, or 5- or 6-membered nitrogen containing heterocyclic groups. Furthermore, $G^{13}$ and $G^{14}$ can be united and represent a group of atoms which is required to complete a cyclic acidic nucleus as normally used in merocyanine dyes and oxonol dyes, such as 2,4-oxazolidindione, 2,4-thiazolidindione, 2-thio-2,4-oxazolidindione, rhodanines, hydantoin, 2-thiohydantoin, 2-pyrazolin-5-ones, 2-iso-oxazolin-5-ones, 3,5-pyrazolidindione, 1,3-indandione, 1,3-dioxane-4,6-dione, 1,3-cyclohexanedione, 2 thioselenazolidin-2,4-diones, barbituric acid and 2-thiobarbituric acid. Moreover, $n^4$ is 0 or 1 and $n^5$ represents 0, 1, 2 or 3.

Those of the aforementioned spectral sensitizers represented by formula (2) in which $G^{13}$ and $G^{14}$ are unified and represent 2-thio-oxazolidin-2,4-diones, rhodanines, 2-thiohydantoins and 2-thioselenazolidin-2,4-diones are preferred.

Rhodacyanine dyes can be represented by formula (3).

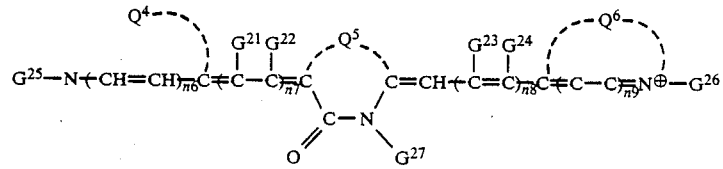

(3)

$(Y^2)_{k3}(W^2)_{k4}$ $Q^4$ and $Q^6$ have the same significance as either $Q^1$ or $Q^2$ in the aforementioned formula (1), and $G^{21}$ and $G^{22}$ have the same significance as either $G^{11}$ or $G^{12}$ in the aforementioned formula (2). $G^{23}$ and $G^{24}$ have the same significance as $G^4$ or $G^5$ in the aforementioned formula (1), and $G^{25}$ and $G^{26}$ have the same significance as either $G^1$ or $G^2$ in the aforementioned formula (1). $Q^5$ represents the elements required to complete a 5-membered nitrogen containing ring. Examples of such 5-membered nitrogen containing rings include 4-oxo-oxazolidine, 4-oxothiazolidine and 4 oxoimidazolidine. $G^{27}$ represents an alkyl group, aryl group or alkenyl group, and these groups may be unsubstituted or substituted groups. Moreover, $n^6$ and $n^9$ are 0 or 1, $n^7$ represents 0, 1 or 2, and $n^8$ represents 0, 1 or 2. $Y^2$ is a cationic group, $W^2$ is an anionic group, and $k^4$ and $k^3$ are 0 or 1 and depend upon the presence or absence of ionic substituent groups.

Reference can be made to the disclosures of JP-A-62-73251 for further details of the dyes described above.

As sensitizing dyes other than the above sensitizing dyes, the same or different kinds of compounds represented by formulae (1) to (3) may be used and preferably dyes in which two dyes among them are linked with a linking group described below are used.

Use can be made of those sensitizing dyes which have a blue, green, red or infrared color sensitive region.

In addition, sensitizing dyes which are described in Japan Chemical Society, *Kagaku Binran,* Applied Chemistry, Vol. 18, Maruzen (1986) can be also referred.

Antifoggants which are used in the present invention include organic compounds as described in the items (1) to (2) below which are adsorbed on the $Ag^+$ site of the silver halide grain surface.

(1) The antifoggants are compounds which contain a saturated or unsaturated 5- to 7-membered ring containing at least one nitrogen atom as a heteroatom, and the ring may also have substituent groups and it may have a condensed ring. Furthermore, the ring may contain heteroatoms other than the nitrogen atom. Compounds which can be represented by formula (4-1) below are one type of preferred compound.

Z—Y (4—1)

In the formula, Z represents in practice an azole ring (imidazole, triazole, tetrazole, oxazole, selenazole, benzimidazole, benzindazole, benztriazole benzoxazole, benzthiazole, thiadiazole, oxadiazole, benzselenazole, pyrazole, naphthothiazole, naphthoimidazole, naphthoxazole, azabenzimidazole or purine), a pyrimidine ring, a triazine ring, a pyridine ring or an azaindene ring (mercaptotetrazole, triazaindene, tetraazaindene, pentaazaindene), and preferably tetraazaindene and mercaptotetrazole.

Furthermore, Y represents a hydrogen atom or a substituent group, and actual examples of substituent groups include substituted or unsubstituted alkyl groups (for example, methyl, ethyl, hydroxyethyl, trifluoromethyl, sulfopropyl, dipropylaminoethyl, adamantane, benzyl, p-chlorophenethyl), alkenyl groups (for example, allyl), aryl groups (for example, phenyl, naphthyl, p-carboxyphenyl, 3,5-dicarboxyphenyl, m-sulfophenyl, p-acetamidophenyl, 3-caprylamidophenyl, p-sulfamoylphenyl, m-hydroxyphenyl, p-nitrophenyl, 3,5-dichlorophenyl, 2-methoxyphenyl), heterocyclic residual groups (for example, pyridine), halogen atoms (for example, chlorine, bromine), mercapto groups, cyano groups, carboxyl groups, sulfo groups, hydroxyl groups, nitro groups, alkoxy groups (for example, methoxy, ethoxy), aryloxy groups (for example, phenoxy), acyl groups (for example, acetyl), acylamino groups (for example, acetylamino, caproylamino, methylsulfonylamino), substituted amino groups (for example, diethylamino, hydroxyamino), alkyl or arylthio groups (for example, methylthio, caroxyethylthio, sulfobutylthio), alkoxycarbonyl groups (for example, methoxycarbonyl) and aryloxycarbonyl groups (for example phenoxycarbonyl).

Other preferred examples of nitrogen-containing heterocyclic compounds include disulfides such as those represented by formula (4-2) below, where Z has the same significance as described above.

Z—S—S—Z (4—2)

Azaindines, azoles and azoles which have mercapto groups are preferred for Z.

Actual examples of tetraazaindines include compounds represented by the formulae (5-1) to (5-4) indicated hereinafter.

(2) The antifoggants are compounds represented by formulae R—SH, R—S—R′, R—SeH, R—Se—R′, R—TeH or R—Te—R′, wherein R and R′ each represents a substituted or unsubstituted alkyl group or a substituted or unsubstituted aryl group, and can refer the explanation of Y in formula (4-1). These compounds are also described in the literature of E. J. Birr as antifoggants. R and/or R′ may be linked with the divalent linking group (i.e., the divalent linking group, L described below) or the adsorbing group is directly linked with the linking group without R and/or R′. These compounds have the advantage in which the synthesis is easily carried out as compared with the compounds in the item (1) because the structure is simple as compared with the compounds in the item (1). However the pendant dye comprising one molecule of the sensitizing dye and one molecule of the compound in the item (2) is not preferred because the function effect of antifoggants is low and thereby the fog is liable to be generated.

The examples of the antifoggants are shown below.

For example, compounds of which a benzene nucleus of hydroquinone is substituted by one or two aryl groups; aromatic amines such as o-phenylenediamine, chloroaniline; aliphatic amines such as $H_2N(RNH)_nRHN_2$; compounds containing a —CONH— group such as carbamide, a compound in which a negative group is introduced to one nitrogen atom of carbamide, salicylamide, acetylating product of aminophenol; thioglycol acids; disulfides such as formylalkylaminophenol disulfide; sulfinic acids and seleninic acid compounds such as benzenesulfinic acid; cysteine; glutathione; vitamin $B_1$; bromobenzene; α,α-dibromodiadipic acid; ethyltrichloroacetate; sulfopyrocatechol; formylalkylaminophenyldisulfide; ethylenediiodide; o- or p-diaminoacetylaminophenol.

In addition to the compounds in the items (1), and (2) as described above, the use of symmetric or unsymmetric compounds in which these antifoggants have been organochemically bonded by means of a divalent linking agent as antifoggants is preferred. Here, the divalent linking agent comprises a divalent linking group which has not more than 20 carbon atoms. Divalent linking groups are groups comprised of alkylene, arylene, alkenylene, —$SO_2$—, —SO—, —O—, —S—,

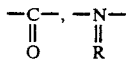

groups (where R represents an alkyl group, an aryl group or a hydrogen atom), divalent linking group having a heterocyclic ring (e.g.,

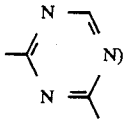

either singly or in combination. For example, reference can be made to the disclosures of JP-A-61-14630, for examples, involving tetraazaindine compounds.

Among the above antifoggants, the compound in the item (1) ca be preferably used as antifoggants in view of the functional effect of antifoggants.

The preferred antifoggants which are used in the present invention are a compound containing a saturated or unsaturated 5- to 7-membered ring containing at least one nitrogen atom as a hetero atom, and a compound represented by formulae R—SH, R—S—R', R—SeH, R—SeH, R—TeH or R—Te—R' wherein R and R' each represents a substituted or unsubstituted alkyl group or a substituted or unsubstituted aryl group.

There are a great many actual examples for these sensitizing dyes and antifoggants of the items (1), (2) and (3), and reference can be made to the disclosures in Shinichi Kikuchi et al, *Kagaku Shashin Binran,* Vol. 1, Maruzen (1959); JP-A-61-14630, JP-A-62-6251, JP-A-62-42148, JP-A-58-113926 to 113928, *Research Disclosure* Journal, Vol. 176 (item 17643) (December 1978), ibid. Vol. 184 (item 18431) (August 1979), ibid. Vol. 216 (item 21728) (May 1982), JP-A-62-73251, A Weissberger, *The Chemistry of Heterocyclic Compounds,* Vol. 18, Interscience, New York (1964), Ibid. Vol. 30, ed. by A Weissberger and E. C. Taylor, John Willy, New York 1977, T. H. James, *The Theory of the Photographic Process,* Fourth Edition, Macmillan, New York, 1977, Chap. 1, 8 to 10, 11, 13, P. Glafkides, *Chimie et Physizue Photographique,* Fifth Edition, Edition de l'Usine Nouvelle, Paris, parts 3 and 6 (1987), Reports on the Progress of Applied Chemistry), Vol. 59, page 159 (1974), JP-B-48-34169, JP-B-47-18008, JP-B-49-23368 (the term "JP-B" as used herein means an "examined Japanese patent publication"), *Yakugaku Zasshi* (Pharmacology Journal), Vol. 74, pages 1365-1369 (1954), Beistein, Chapter XII, page 394, Chapter IV, page 121, *Stabilization of Photographic Silver Halide Emulsions,* by E. J. Birr, Focal Press, London (1974) and the literature cited therein, P. Wulff and B. Wendt, *Ger.* 445, 753 (1926), Japanese Patent Application No. 63-78465, and the Japanese Chemical Society Publication entitled *Shinjikken Kagaku Koza* (New Experimental Chemical Course) 14, Maruzen, Tokyo (1978).

The pendant type dyes of this invention are described in more detail below. The pendant type dyes can be represented in general by the formulae (6) and (7) indicated hereinafter, where L represents a divalent linking group which has not more than 20 carbon atoms. Here, a divalent linking group is comprised of alkylene, arylene, alkenylene, —$SO_2$—, —SO—, —O—, —S—,

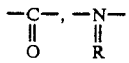

groups (where R represents an alkyl group, an aryl group or a hydrogen atom), either singly or in combination. Moreover, l, m and n are integers, l/n is from 2/1 to 1/4 (with m being equal to l or n), and l/n is preferably from 2/1 to 1/2. This is because although greater functionalization can be achieved by increasing the values of l and n, the cost of preparation is also increased and the overall cost is increased. $n^2$ in formula (7) represents 3, 2, 1 or 0, and preferably 0 or 1. $L^2$ in formula (7) has the same significance as L described above. That is, it means that the sensitizing dye is not directly linked with the antifoggants. When $n^2$ is 1, 2 or 3, the plural sensitizing dyes in formula (7) may be the same or different with the antifoggants. For example, the compounds in the items (1), (2) and (3) can be used as antifoggants singly or in combination. In formulae (6) and (7), the embodiment in FIG. 1 can be more preferably used. That is, the embodiment in FIG. 1 is an example in which the sensitizing dye is coercively adsorbed on the silver halide grain by adsorbing the antifoggants of both sides of the sensitizing dye on the silver halide grain. The embodiment has an advantage in which the sensitizing dyes can be extremely function-separated in the molecular design. In FIG. 1, n represents an integer of 1, 2 or 3 and preferably is an integer of 1 or 2. The case of the cyanine dye and the tetraazaindene compound shown as formula (8) is described as a typical example, but this invention is not limited by this example. The pendant dye is a compound in which at least one of the groups F, G, I, and J of the tetraazaindine compound is bonded organochemically with an $A_1$, $A_1'$, $A_2$, $A_2'$, $B_1$, $B_1'$, $B_2$, $B_2'$, $C_1$, $C_1'$, $C_2$, $C_2'$ or R group of the cyanine dye. Here, the groups $A_1$ to R, and the groups F, G, I and J represent the same groups as those represented by $G_1$ to $G_5$ in formula (I). The aforementioned groups $A_1$ to R are possible bonding positions for the antifoggants on the cyanine dye; but the bonding of the antifoggant causes steric hindrance between substituent groups within the molecule, and this may distort the conjugated system of the cyanine dye and cause a marked reduction in the extinction coefficient, and the adsorption site of the sensitizing dye may not be able to approach the AgX grain surface because of steric hinderance. These effects are undesirable since they reduce the color sensitized speed. The magnitude of the effect changes in the order R>A>B, C and bonding is preferably carried out at a position selected so that such undesirable effects do not arise. From this viewpoint, the preference for bonding decreases in the order B, C>A>R. However, the preferred bonding position can be selected in each individual case by synthesizing the actual compounds, adding them to an AgX emulsion, and measuring the said extinction coefficient, and the adsorption properties and color-sensitization efficiency.

The embodiment shown in formula (7) is preferred in that it reduces the number of conformations which the dye molecule can adopt, limits scissoring, rotational and vibrational motion and reduces the probability of non-radiative deactivation of the photo-excited state. Moreover, there is a further effect in the case of unstable infrared sensitizing dyes in that the degree of freedom of molecular motion is reduced and their thermal stability is improved.

By way of example, the groups $R^1$ to $R^5$ in formula (9) are preferred as the bonding positions on the merocyanine side in the case of a merocyanine dye/antifoggant type pendant type dye. Here again, as in the case of the cyanine dyes mentioned above, the selection of a position which is not associated with a reduction in the extinction coefficient of the said sensitizing dye, with which there is little steric hindrance at the time of adsorption, and with which good color-sensitization efficiency can be obtained is preferred for the bonding position.

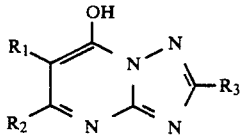

(5-1)

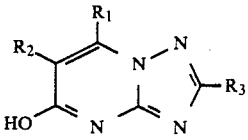

(5-2)

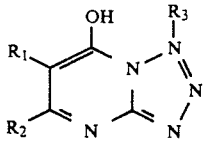

(5-3)

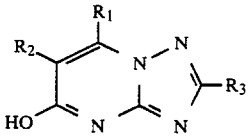

(5-4)

$R_1$ to $R_4$: H, halogen atom, amino group, alkyl group, aryl group.

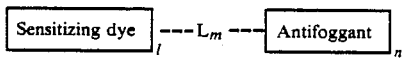

(6)

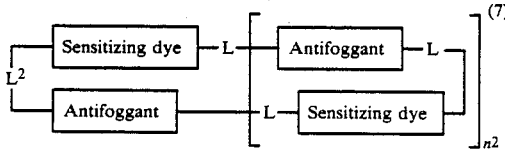

(7)

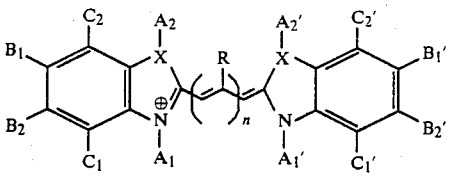

-continued

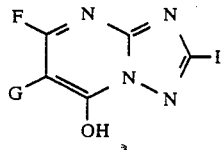

(8)

X=(S, O, CH=CH, Se, N, $C(CH_3)_2$)
n=0, 1, 2, 3, 4
R: Same as $G^4$ in formula (1)

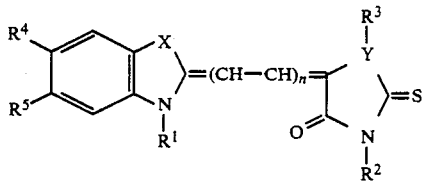

(9-1)

X=O, N, S, Se
X=O, S, Se
n=0, 1, 2, 3, 4
$R^1$, $R^2$, $R^3$: Same as (RO) in formula (I)

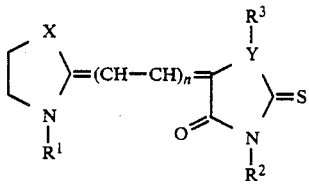

(9-2)

The preferred pKa for the antifoggant used in the said pendant type dye differs according to the halogen composition of the AgX substrate surface which is to be adsorbed. This is because, as described in the item (3) above, the strength of adsorption of the antifoggant becomes stronger as the difference [pKsp of the antifoggant—pKsp of the AgX at the substrate surface] becomes larger and there is a danger that the inhibition of development will become too great. Normally, the preferred range for the pKa value is from −2 to 3.5, and more preferably the value is within the range of from −1.5 to 2.5.

Actual examples of pendant type dyes of this invention and examples of their preparation are described below, but the pendant type dyes of this invention are not limited by these examples.

1. Acid Amide, Cyclic Imide Synthesis Reaction

A salt is produced by the acid and the base when a sensitizing dye which has an acid residual group, [(S1)COOH], and an antifoggant which has an amine residual group, [$(A1)NH_2$], are mixed together, and an acid amide is formed if this is heated to a high temperature, or if the reaction equilibrium is displaced to the production side by removing the water which is produced by either by azeotropic distillation or by means of a dehydrating agent such as $ZnCl_2$ or $CaCl_2$ for example.

$$(S1)\text{—}COOH + (A1l)\text{—}NH_2 \rightleftharpoons (S1)CO_2{}^{63}NH_3{}^{6-}{}_{1}(A1) \rightarrow (S1)CONH(A1)$$

A pendant dye which has the structure shown by formula (7) is produced on mixing a sensitizing dye which has a two carboxylic acid residual groups [(S2)(COOH)$_2$] with an antifoggant which has one or more amine residual group and removing the $H_2O$ which is produced while heating the mixture.

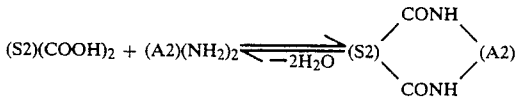

(11)

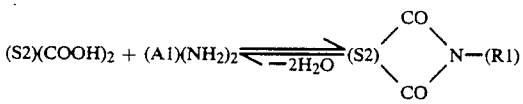

(12)

However, in such a case the use of a reaction such as that shown in equation (13), for example, in which one of the functional groups is protected, is preferred in order to prevent the production of oligomers by means of a side reaction.

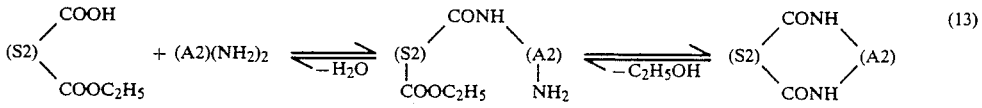

(13)

Another carbobenzyloxy group or a carbethoxy group can be used for the protective group. Reference can be made to the description of peptide synthesis in the literature mentioned hereinafter in connection with this acid amine synthesis reaction.

The following compounds can be cited as actual examples of (S1l)COOH.

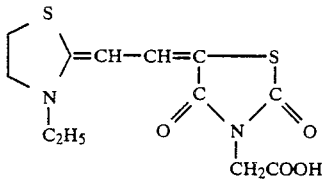

(14-1)

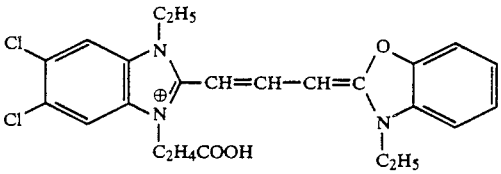

(14-2)

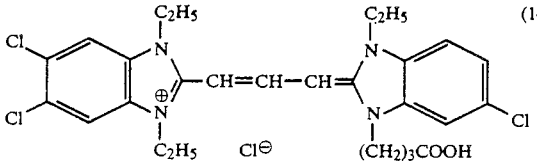

(14-3)

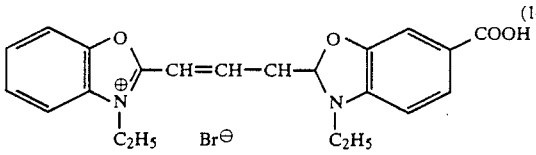

(14-4)

-continued

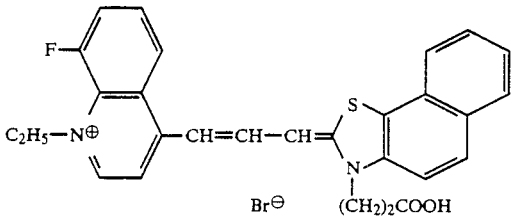

(14-5)

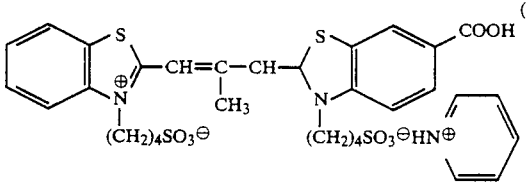

(14-6)

The following compounds can be cited as actual examples of (R1)NH$_2$ and (R2)(NH$_2$)$_2$.

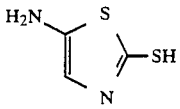

(15-1)

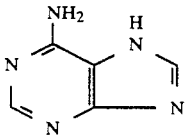

(15-2)

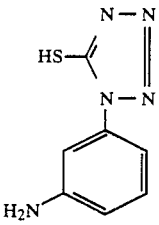

(15-3)

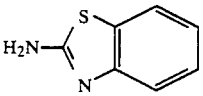

(15-4)

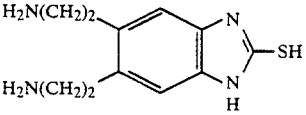

(15-5)

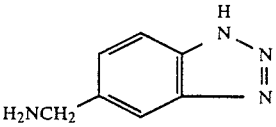

(15-6)

-continued

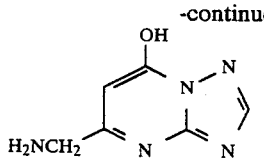

(15-7)

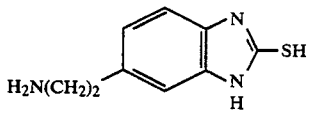

(15-8)

$CH_3SCH_2CH_2\underset{\underset{NH_2}{|}}{CH}-COOH$ (15-9)

$NH_2-CH_2-CH_2-SH$ (15-10)

$NH_2-CH_2-CH_2-S-CH_2-CH_3$ (15-11)

$\underset{\underset{S-CH_2-CH(NH_2)-COOH}{|}}{S-CH_2-CH(NH_2)-COOH}$ (15-12)

The following compounds can be cited as actual examples of $(S2)(COOH)_2$.

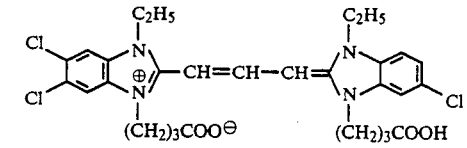

(16-1)

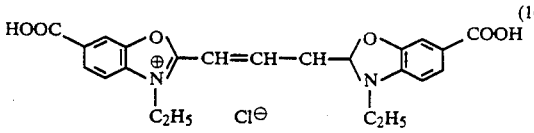

(16-2)

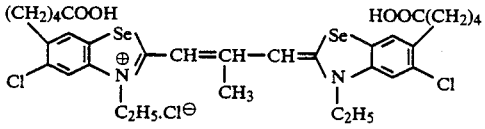

(16-3)

Furthermore, all the acid amide and acid imide compounds between the aforementioned (S1)(COOH), $(S2)(COOH)_2$ and $(A1)NH_2$ can be cited as actual examples of pendant type dye compounds. For example:

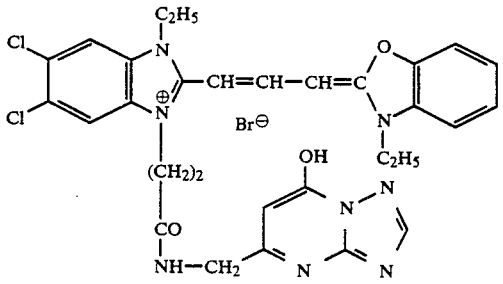

(17-1)

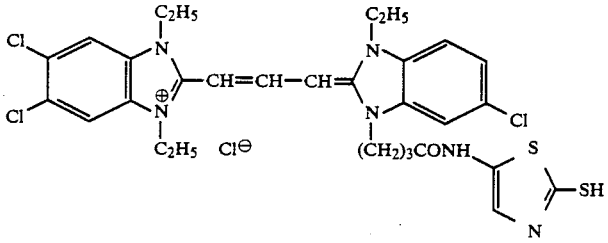

(17-2)

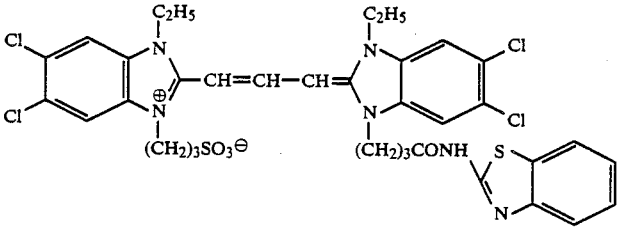

(17-3)

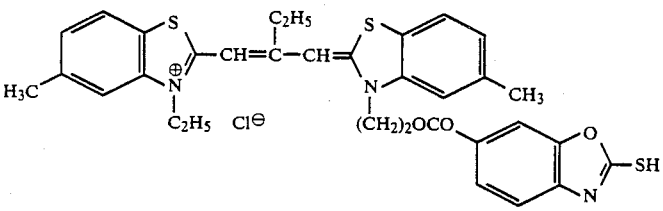

(17-4)

-continued
(17-5)
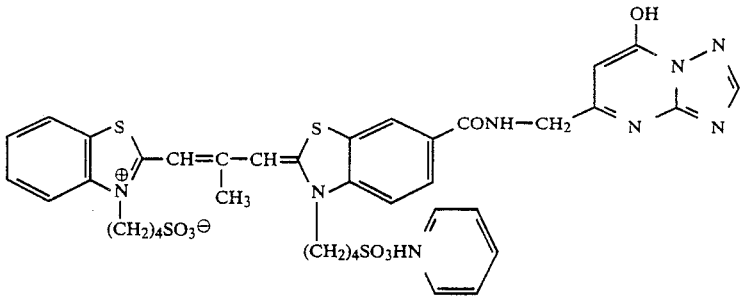
(17-6)
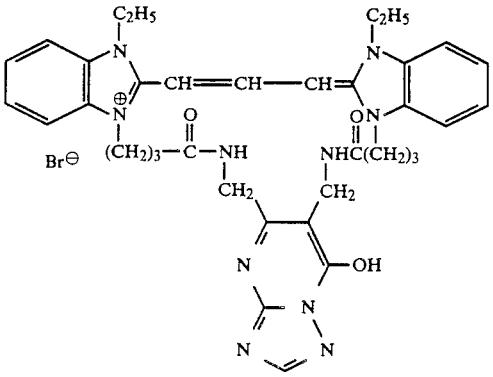
(17-7)
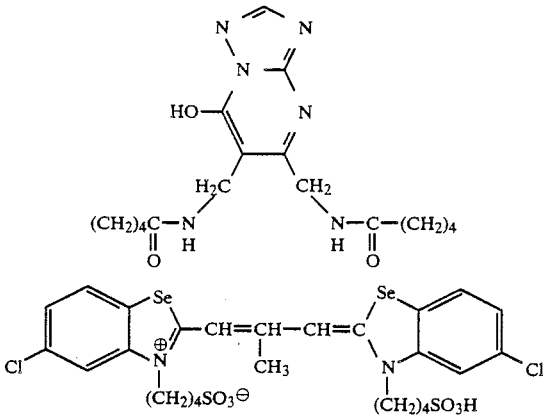
(17-8)
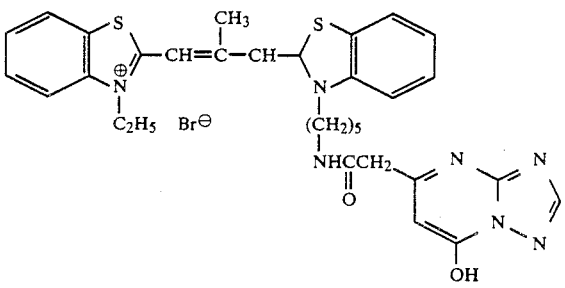

-continued (17-9)

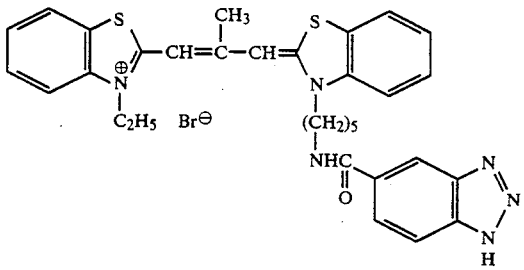

It is seen that the acid amide, acid imide synthesis reaction can also be performed by reacting sensitizing dyes which have amine residual groups with antifoggants which have acid residual groups.

Also, the acid amide or acid imide linking reaction may be performed by the realcohol (or rephenol) reaction between the sensitizing dye having amine residual groups and the antifoggants having ester residual groups in place of the acid residual groups 2. Esterification SYnthesis Reaction It is possible to synthesis the pendent dye from a sensitizing dye which has an alcohol residual group, [(S3)OH], and an antifoggant which has an acid residual group, [(A3)COOH , by means of a dehydration reaction. The reaction proceeds in the presence of an acid catalyst and on removing the $H_2O$ which is produced by means of azeotropic distillation or by means of a dehydrating agent, such as $ZnCl_2$ or $CaCl_2$ for example. Such reactions can be represented by the following equations.

$$(S3)OH + (A3)COOH \underset{-2H_2O}{\rightleftharpoons} (S3)COO(A3) \quad (18)$$

$$(S4)(OH)_2 + (A4)(COOH)_2 \underset{-2H_2O}{\rightleftharpoons} (S4)\begin{matrix}OCO\\OCO\end{matrix}(A4) \quad (19)$$

The following actual examples of (S3)OH, $(S4)(OH)_2$, (A3)COOH and $(A4)(COOH)_2$ can be cited in this case.

(S3)OH, $(S4)(OH)_2$:

(20-1)

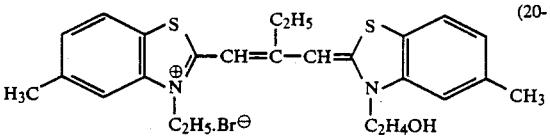

(20-2)

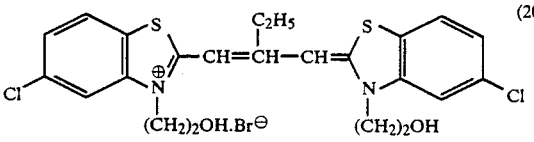

(20-3)

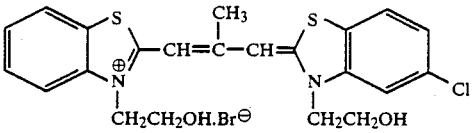

-continued (20-4)

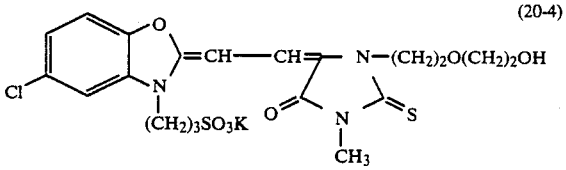

(R3)COOH, $(R4)(COOH)_2$:

(21-1)

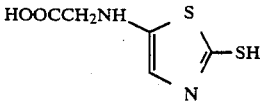

(21-2)

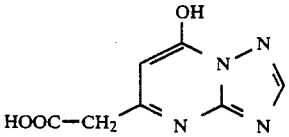

(21-3)

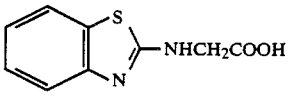

(21-4)

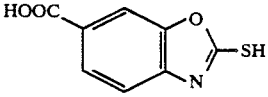

(21-5)

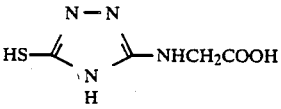

(21-6)

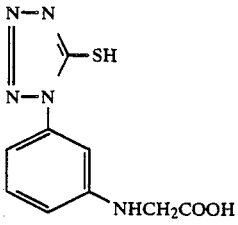

(21-7)

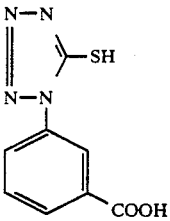

-continued

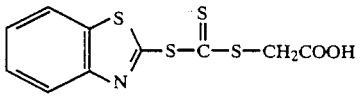

(21-8)

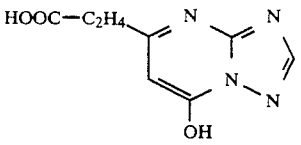

(21-9)

Furthermore, all the ester compounds between the aforementioned (S3)OH, (S3)$(OH)_2$ and (A3)COOH, (A4)$(COOH)_2$ can be cited as actual examples of pendant type dye compounds. For example.

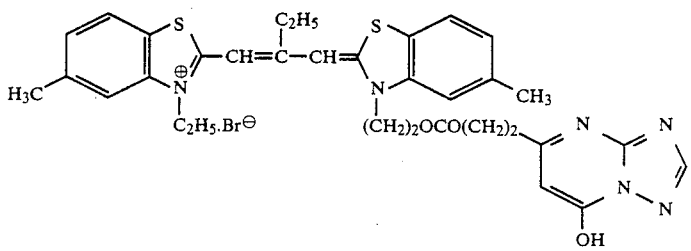

(22-1)

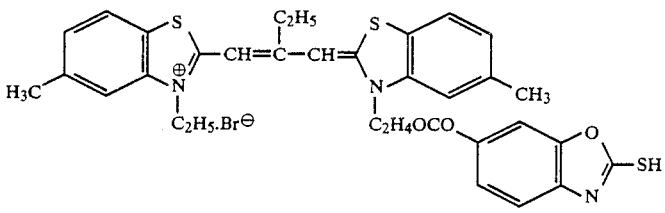

(22-2)

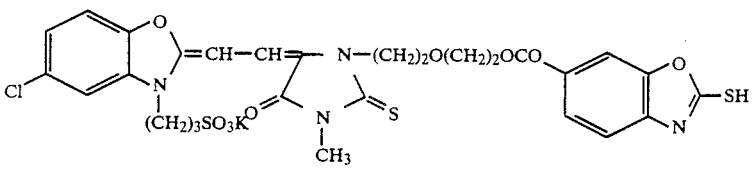

(22-3)

It is seen that this ester synthesis reaction can also be carried out by reacting sensitizing dyes which have acid residual groups with antifoggants which have alcohol residual groups.

3. Other Reactions

Apart from those mentioned above, there are many reactions by which sensitizing dyes and antifoggants can be chemically bonded, and the best method of synthesis can be used in each case. Some of these methods of synthesis are illustrated below.

a. Chemical Bond Formation by the Reaction of an Anionic Reagent with Aliphatic Carbon Anionic reagents are almost without effect on saturated aliphatic hydrocarbons, but if an electron attractive substituent group X [for example, a halogen ($Cl^{31}$), a carboxylic acid residual group (R'COO—), or a sulfonic acid residual group (R'—$SO_3$—)] is introduced, the carbon becomes positive and reacts with anionic reagents [for example, sodium alcoholate (NaOR), the sodium salt of a fatty acid (NaOCOR), sodium plenoxide

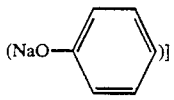

to form a chemical bond.

For example:

$$R—X+NaOR' \rightarrow R—O—R'+NaX \quad (23)$$

$$R—X+NaOOCCH_3 \rightarrow R—OOCCH_3+NaX \quad (24)$$

$$R—X+NaOAr \rightarrow R—O—Ar+NaX \quad (25)$$

$$R—X+H_2N—R' \rightarrow R—NHR'+HX \quad (26)$$

b. Reaction of Anionic Reagents with Carbonyl or Thiocarbonyl Carbon

Carbonyl or thiocarbonyl carbon is generally positive, but the said carbon is rendered more positive in acid chlorides because of the electron attractive properties of the chlorine atom and these compounds therefore react rapidly with anionic reagents. The reaction is irreversible.

For example:

$$RCOCl+HOR' \rightarrow RCOOR'+HCl \quad (27)$$

$$RCOCl+H_2N—R' \rightarrow RCONHR'+HCl \quad (28)$$

$$RCOCl+HO—Ar \rightarrow RCOOAr \quad (29)$$

$$ArCOCl+ROH \rightarrow ArCOOR \quad (30)$$

In example of this reaction, a linking reaction in which isocyanate, thioisocyanate or precursor thereof (i.e., urethane or thiourethane) and the anionic reagents are reacted, is also included.

For example:

$$\underset{\underset{W_1}{\|}}{RNHCORR''} + HOR' \longrightarrow \underset{\underset{W_1}{\|}}{RNHCOR'} \quad (27')$$

$$\underset{\underset{W_1}{\|}}{RNHCOR''} + H_2N{-}R' \longrightarrow \underset{\underset{W_1}{\|}}{RNHCNHR'} \quad (28')$$

$$\underset{\underset{W_1}{\|}}{RNHCOR''} + HO{-}Ar \longrightarrow \underset{\underset{W_1}{\|}}{RNHCOAr} \quad (29')$$

$$\underset{\underset{W_1}{\|}}{ArNHCOR''} + ROH \longrightarrow \underset{\underset{W_1}{\|}}{ArNHCOR} \quad (30')$$

In the above formula, $W_1$ represents an oxygen atom or a sulfur atom.

For example:

$$RX + BF_3 \rightleftharpoons R^+ + BR_3X^- \xrightarrow{R'H} R{-}R' \quad (31)$$

$$R{-}CH{=}CH_2 + H_2SO_4 \rightleftharpoons R{-}\overset{+}{C}H{-}CH_3 + HSO_4^- \xrightarrow{R'H} \underset{\underset{R'}{|}}{R{-}CH{-}CH_3} \quad (32)$$

However, since the reactivity decreases in the order tertiary carbonium ion>secondary carbonium ion->primary carbonium ion, it is difficult to alkylate with a primary carbon under normal conditions, alkylation with secondary carbon only occurs when a powerful catalyst such as $AlCl_3$ is used, but alkylation with tertiary carbon is possible even when a comparatively weak catalyst such as $H_2SO_4$ or $BF_3$ is used.

Reactive Example:

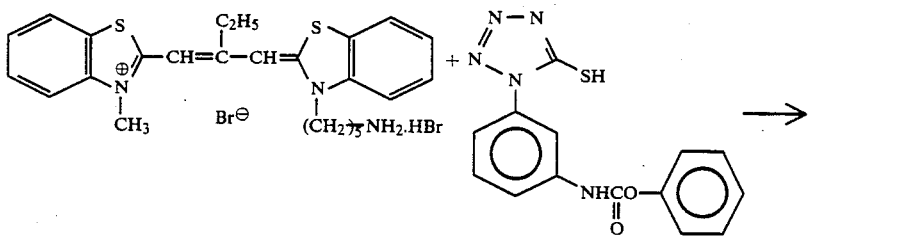

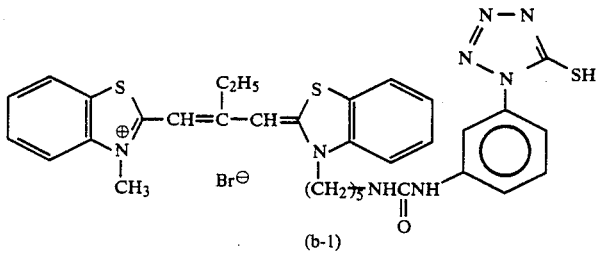

(b-1)

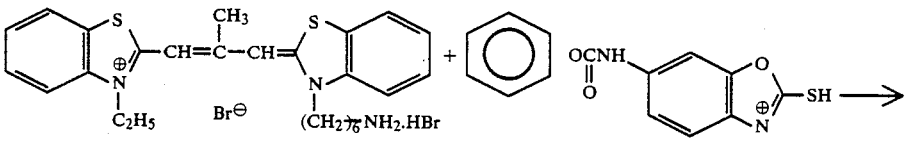

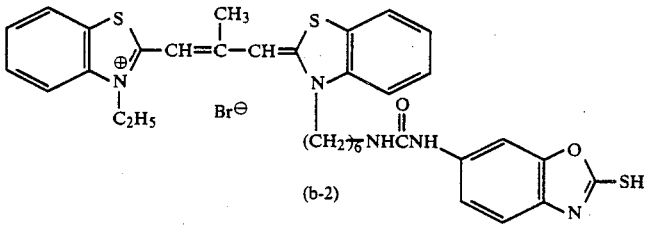

(b-2)

c. Carbon Alkylation Reactions

These are reactions in which an alkyl group is bonded to carbon. A carbonium ion is produced by the action of an electrophilic catalyst, such as $AlCl_3$, $BF_3$, $ZnCl_2$, $H_2SO_4$, $H_3PO_4$ or HF, for example, on an alkyl-halide, an olefin, an alcohol, an ether or an ester, and the carbonium ion can attack carbon on which a comparatively negative charge has accumulated, and a bond is formed.

d. Nucleophilic ubstitution Reaction due to Anionic Reagents on Heterocyclic Ring When on the heterocyclic ring, an excellent releasing group (e.g., a halogen atom, an alkoxy group, a phenoxy group and a sulfonyl group) is present, the linking reaction is proceeded by the nucleophilic substitution reaction with the anionic reagent.

Reactive Example:

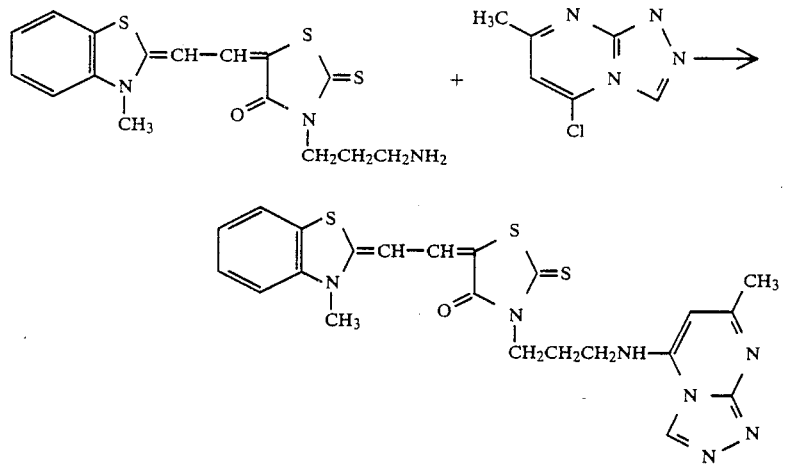

(d-1)

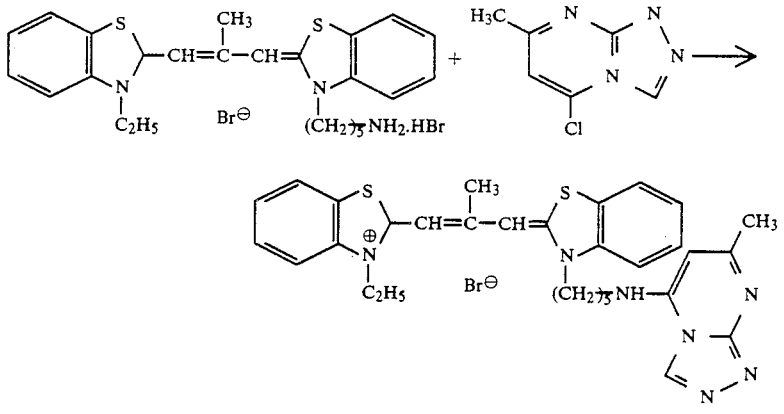

(d-2)

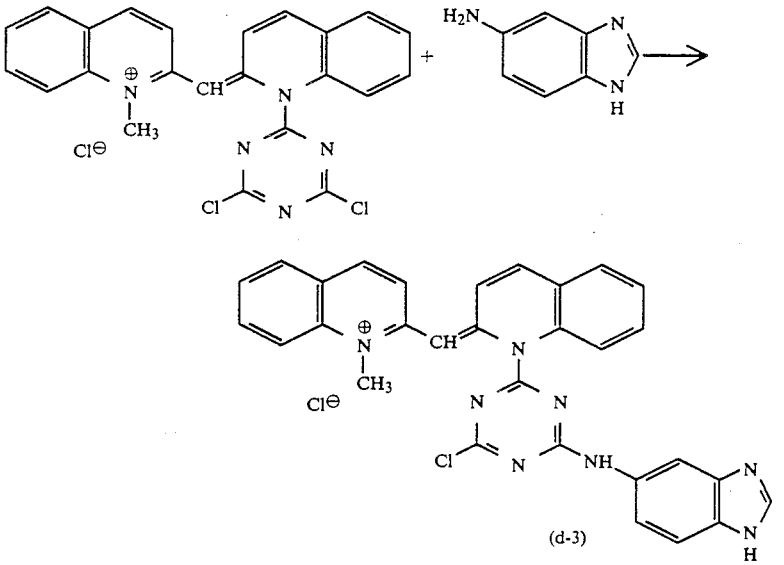

(d-3)

In the case of this invention however, the reactive groups in the aforementioned reaction are substituted residual groups of sensitizing dyes, antifoggants or linking agents, or substituent residual groups of the raw materials thereof.

e. Method Which Antifoggants are Previously Bonded with the Raw Materials for the Dye Synthesis In addition to the methods in which synthesis is effected by reaction between substituent groups of sensitizing dyes and antifoggants, methods in which the antifoggant is pre-bonded onto a reagent which is used in the synthesis of the dye, as indicated in the following equation, are also effective routes for the synthesis the pendent dyes of this invention.
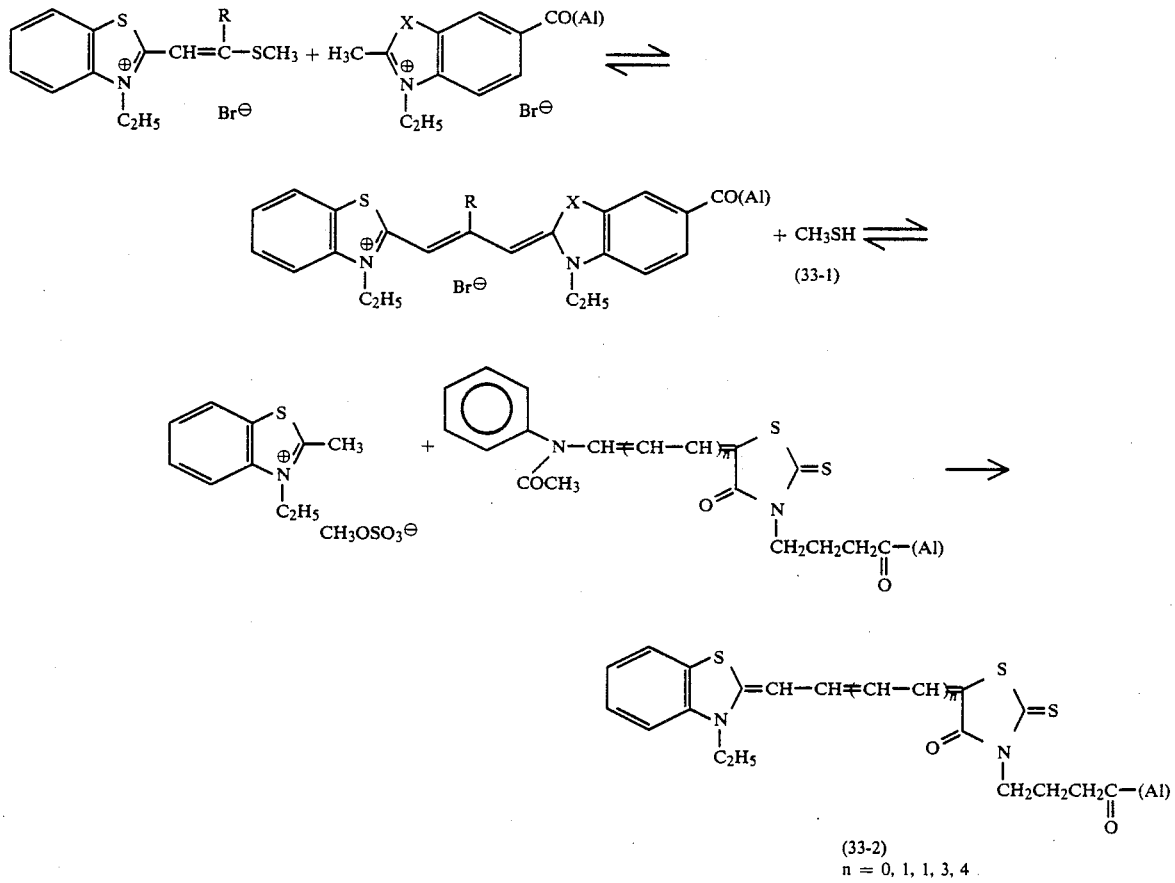
(33-1)
(33-2)
n = 0, 1, 1, 3, 4
Reactive Example
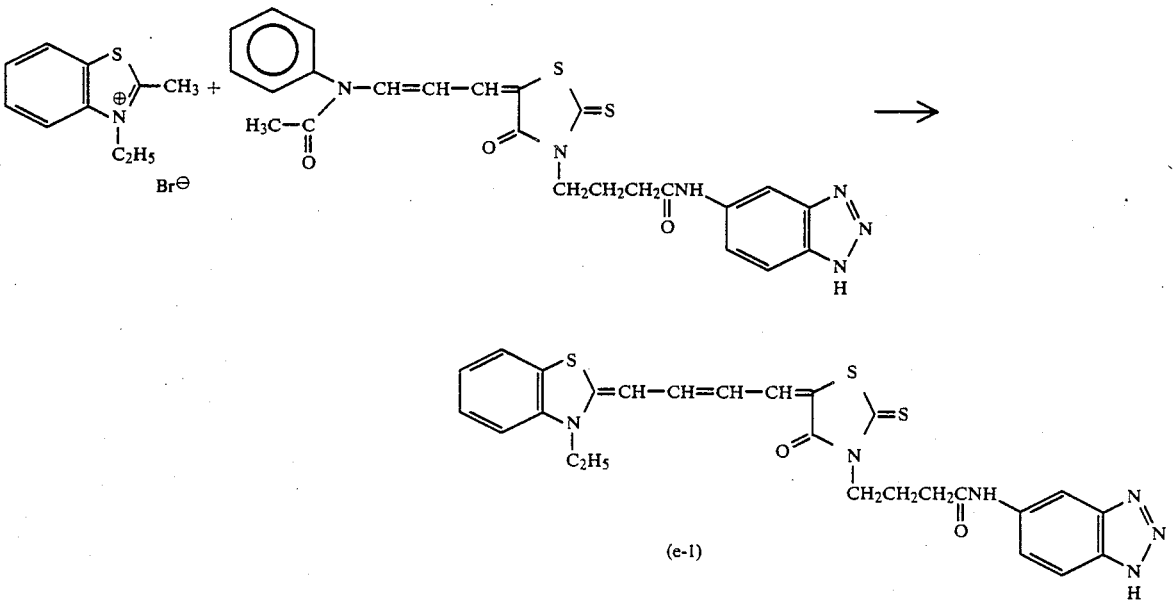
(e-1)

-continued
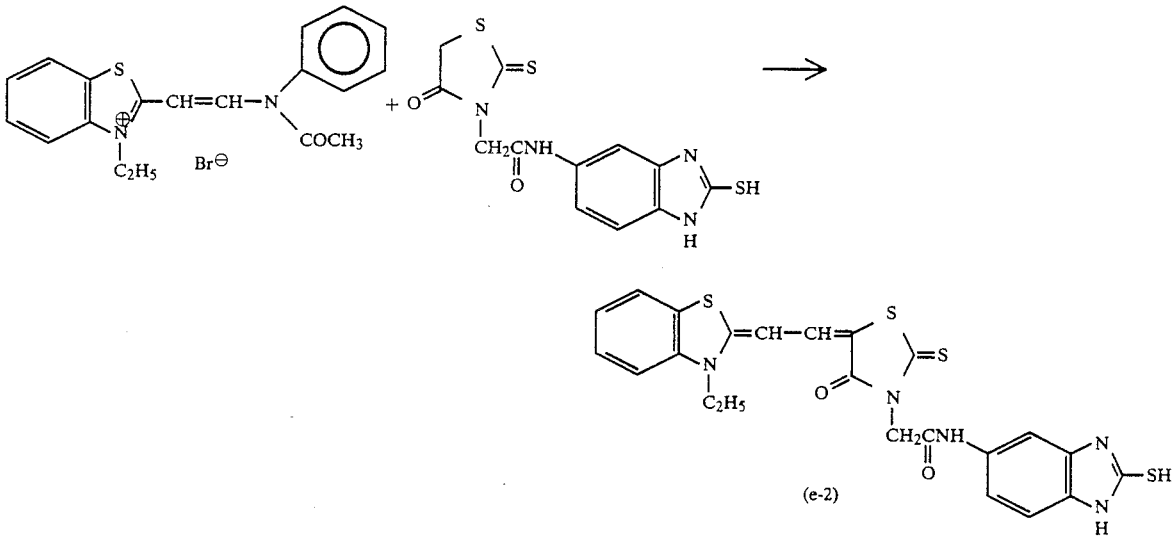
(e-2)
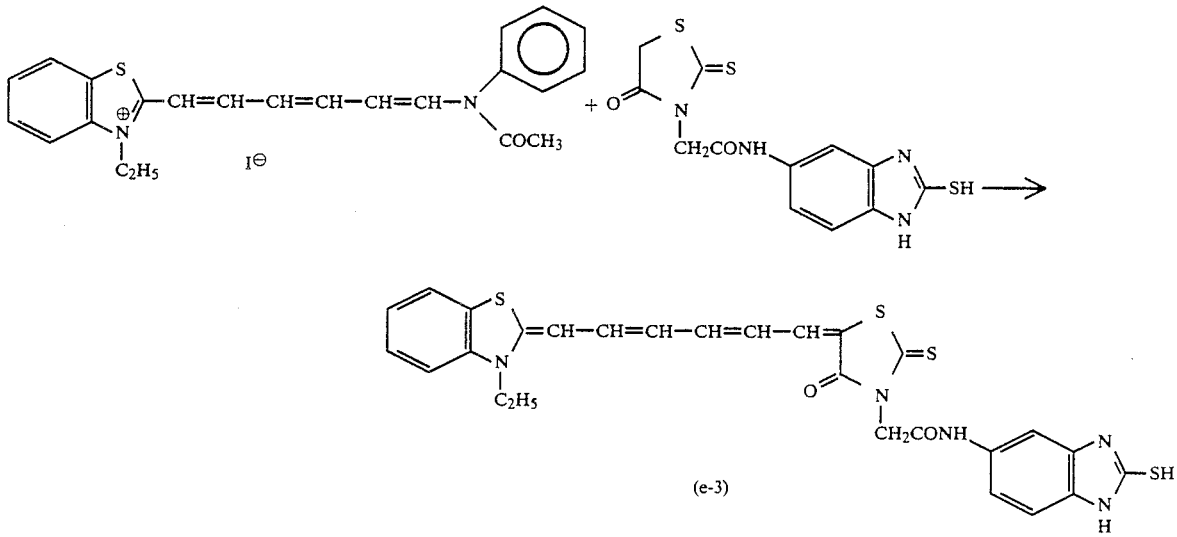
(e-3)
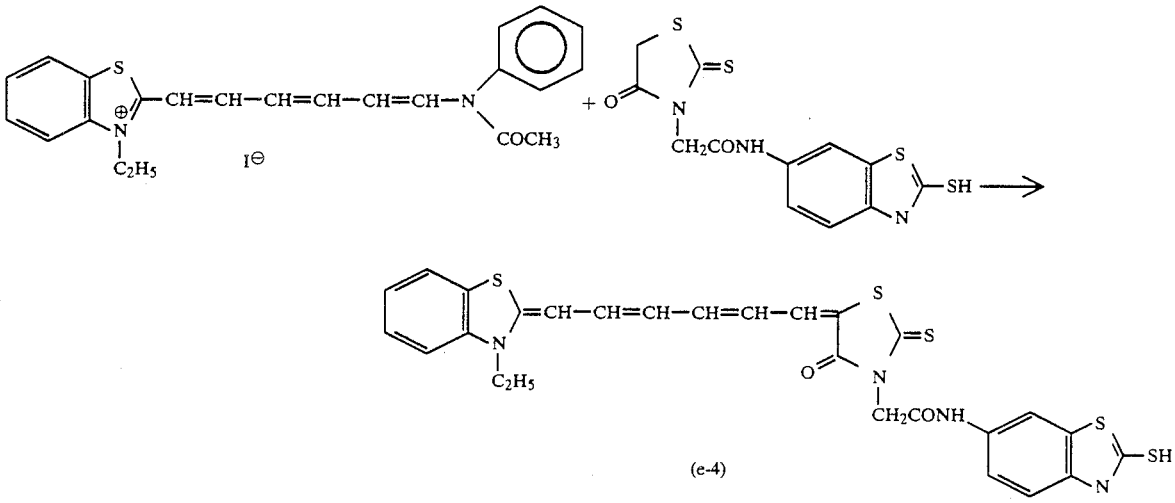
(e-4)
Prepared sensitizing dyes are liable to be decomposed if they are reacted with antifoggants and linking agents and so strongly oxidizing reactions cannot be used, and the use of the said raw materials is advantageous in that such reactions can be used in such a case.

f. Method in Which the Linking Agent is Previously Bonded

On the other hand, methods in which a linking agent is reacted with a sensitizing dye residual group and then an antifoggant is bonded to the said linking agent moiety may be adopted, and a linking agent may also be reacted with an antifoggant, after which a sensitizing dye may be bonded to the linking agent moiety.

Examples of the reaction and compounds are shown below.

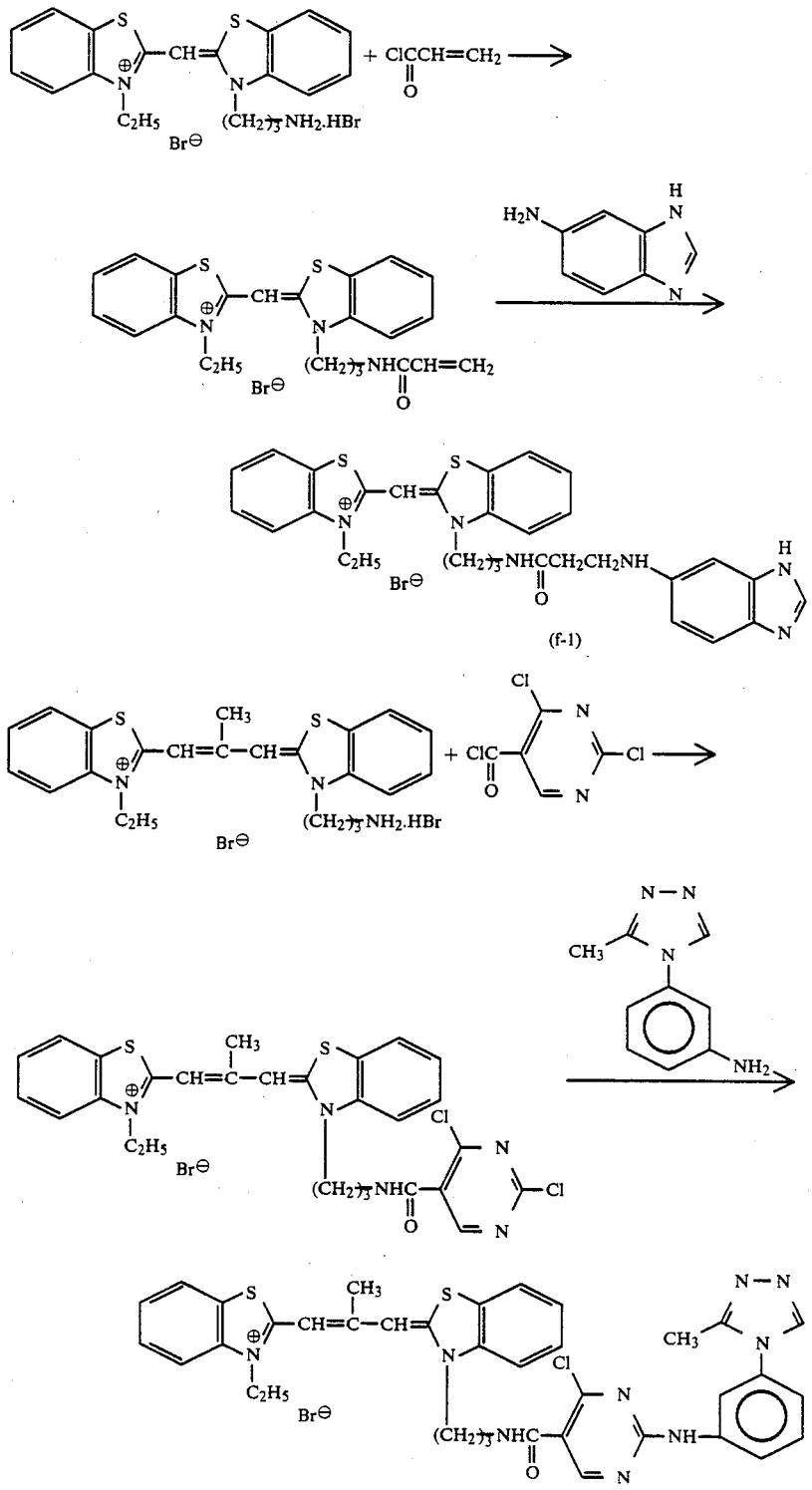

(f-1)

(f-2)

In the description above, R, R′ and R″ represent substituted or unsubstituted alkyl groups or substituted or unsubstituted aryl groups, and Ar represents an aryl group.

Reference can be made to the descriptions given in the Japan Chemical Society publication entitled *Shinjikken Kagaku Koza* (New Experimental Chemistry Course) 14, *Synthesis and Reactions of Organic Compounds*, Vol. I to V, Maruzen Tokyo (1977), by K. Ogata in Yuki Hanno Ron (The Theory of Organic Reactions), Maruzen, Tokyo (1962); in JP A-51-117619; and in L. F. Fieser and M. Fieser, *Advanced Organic Chemistry*, Maruzen, Tokyo (1962) for details of the reactions in 1 to 3 above, and in connection with methods for the synthesis of divalent linking groups.

Furthermore, reference can be made to the descriptions in the reference literature for actual examples of the sensitizing dyes and antifoggants mentioned above, and to the literature cited therein for details of the synthesis of the above mentioned sensitizing dyes (S1) to (S4) and antifoggants (Al) to (A4).

Also, the synthetic methods of Compounds (d-2), 17-9), 17-8), (b-1), (e-2), (e-3) and (e-4) and the detail of the pendant type dyes are referred to Japanese Patent Application No. 1-15754.

The dispersion media normally used in AgX emulsions can be used for the dispersion media used in the AgX emulsions of this invention, and various hydrophilic colloids, and notably gelatin, can be used for this purpose. Gelatin is normally preferred and, in addition to the alkali-treated gelatins, acid-treated gelatins, gelatin derivatives such as phthalated gelatins, low-molecular weight gelatins (molecular weight: 1,000 to 100,000, including enzymatically decomposed gelatins and hydrolyzed gelatins prepared using acid or alkali) can be used as the gelatin, and mixtures of these gelatins can also be used.

The substances obtained by reacting gelatin with various compounds such as acid halides, acid anhydrides, isocyanates, bromoacetic acid, alkane sulfones, vinyl-sulfonamides, maleimido compounds, polyalkyleneoxides and epoxy compounds, for example, can be used as gelatin derivatives. Furthermore, graft polymers of gelatin and other high molecules, proteins such as albumin and casein, cellulose derivatives such as hydroxyethylcellulose, carboxymethylcellulose and cellulose sulfate esters, sugar derivatives such as sodium alginate, starch derivatives, and various synthetic hydrophilic polymers, including homopolymers such as poly(vinyl alcohol), partially acetalated poly(vinyl alcohol), poly-N-vinylpyrrolidone, poly(acrylic acid), poly(methacrylic acid), polyacrylamide, polyvinylimidazole and polyvinylpyrazole, and copolymers.

No particular limitation is imposed upon the halogen composition of the silver halide grains, the form of the grains or the grain size in the AgX emulsions of this invention.

Thus, AgX emulsion grains with known halogen compositions, grain forms and grain sizes can be used. AgCl, AgBr, AgBrI and mixed crystals in the range within the solid solution limit of these crystals can be used. However, cyahine dyes are adsorbed weakly and antifoggants are adsorbed strongly on AgX grains of which the grain surface has a high Cl content and the undesirable effects referred to the item (3) are pronounced in such a case. Hence, the effect of this invention is especially pronounced with AgX grains of which the grain surface Cl content is generally at least 40 mol %, preferably at least 60 mol %, and more preferably at least 70 mol %. Thus, with the AgX emulsions of this invention, the effects are greater in cases where generally at least 60%, and preferably at least 70%, of the total projected surface area of the AgX grains is accounted for by AgX grains of which generally at least 60%, and preferably at least 70%, of the said grain surface has a $Cl^{31}$ content of 40 mol % or more, preferably 60 mol % or more and more preferably 70 mol % or more. Furthermore, dyes are strongly adsorbed and antifoggants are weakly adsorbed in those cases where the grain surface iodide content is high, and there are cases in which the effect of the antifoggant is inadequate. In such cases, the pendant type dyes of this invention have the effect of improving the adsorption properties of the antifoggants and improving the antifoggant action effect. This effect is greater when the iodide content of the grain surface is within the range of from 3 mol % to the solid solution limit, and preferably within the range of from 5 to 30 mol %. Hence, with the AgX emulsions of this invention, the effect is greatest when generally at least 60%, and preferably at least 70%, of the total projected area of the said AgX grains is accounted for by AgX grains of which generally at least 60%, and preferably at least 70%, of the said grain surface has an $I^-$ content of generally from 3 mol % to the solid solution limit, and preferably of from 5 to 30 mol %. The "grain surface" in these cases signifies a layer three atoms deep, and preferably a layer twenty atoms deep, from the surface.

Silver halide grains of grain size, as a corresponding sphere diameter, of from 0.02 μm to 5 μm can be used for the AgX grains.

The AgX grains in an AgX emulsion of this invention may have a cubic, tetradecahedral, or octahedral, or an orthorhombic dodecahedral, triaxisoctahedral, isositetrahedral, tetraaxishexahedral or hexaoctahedral form. Reference can be made to the descriptions by E. Moisar and E. Klein in *Ber. Bunsenges. Phy. Chem.*, 67. 949 (1963), ibid , 63, 356–359, in R. W. Beriman, *J. Photogr. Sci.*, 12, 121 (1964), in K. Murofushi et al., *International Congress of Photographic Science*, Tokyo (1967), in J. E. Maskasky, *J. Imag. Sco.*, 30, 247–254 (1986), in JP-A-62-42148, JP-B-55-42737, Kokai Giho 86-9598, European Patent No. 171,238, JP-A-62-123446, JP-A-62-123447, JP-A-62-124550 to JP-A-62-124552, JP-A-63-27831, JP-A-63-41845, JP-A-63-25654 and Japanese Patent Application No. 62-291487 for details of these grains.

The use of the grains which have a uniform composition disclosed in Japanese Patent Applications Nos. 63-115641 and 63-162144 as mixed crystal AgX grains is preferred.

On the other hand, use can be made of AgX grains which are essentially free of twinned crystal planes and AgX grains of which the grain size distribution is a mono dispersion, with grains of the forms mentioned above. Reference can be made to the disclosures in Japanese Patent Application No. 63-84664 for details.

Furthermore, conventional tabular grains and tabular grains of which the form of the principal plane is hexagonal or circular and of which the grain size distribution is a mono-dispersion can also be used. Reference can be made to the disclosures in U.S. Pat. Nos. 4,439,520, 4,433,048, 4,434,226, 4,797,354, JP-A-58-108525, JP-A-61-6643, JP-A-52-153428, European Patent No. 0,227,444, U.S. Pat. No. 4,713,320, Japanese Patent Application Nos. 62-319740 and 62-203635 for details.

Grains which have a large specific surface area are preferred from the point of view of raising the spectrally sensitized speed, and tabular grains are preferred in this respect. In this case, the effect is greater with grains with an aspect ratio of generally at least 2, and preferably of from 4 to 20.

The above mentioned mono-disperse tabular AgX grain systems enable the effect of this invention to be realized especially effectively. In this case, the amount of adsorbed dye per grain can be increased because of the large specific surface area, AgX photographic materials which have a particularly high speed and high image quality can be obtained because of the spectral sensitization efficiency improving effect of this invention and the effect of the mono disperse tabular grains disclosed in Japanese Patent Application No. 62-319740, and this is preferable. The term "mono-disperse tabular grains" in this case denotes tabular AgX grains of which generally at least 70%, preferably at least 90%, and more preferably at least 95%, of the total projected surface area of the said silver halide grains is accounted for by tabular AgX grains which have 2 twinned crystal planes which are parallel to the principle plane, of which the variation coefficient (C.V.) of the grain size distribution of the tabular AgX grains is generally not more than 30%, preferably not more than 20%, and more preferably not more than 15%, and of which the aspect ratio is generally at least 2, and preferably from 4 to 20. Here, the aspect ratio is the ratio of the diameter to the thickness of the tabular grain. The term "diameter of the grain" as referred to herein denotes the diameter of a circle which has an area equivalent to the projected surface area when the grain is observed under a microscope or electron microscope.

The halogen composition structure of the AgX grains of this invention may be uniform, or the inner and outer parts may provide a heterogeneous halogen composition, or the grains may have a layer structure. The change in the halogen composition between layers may be of a gradually increasing type, a gradually decreasing type or an abrupt type, and these types of change can be used according to the intended purpose.

Other known AgX grains, such as epitaxial grains which have a host part and an epitaxially grown part, ruffled grains, and grains which have dislocation lines can also be used. Reference can be made to the disclosures in Japanese Patent Application Nos. 62-319740 and 63-223739 in this connection.

The said pendant type dyes can be added at any stage from the time of AgX grain formation up to completion of the coating process, but the addition is normally made during the period from after grain formation until immediately prior to coating. The addition is made before chemical sensitization ripening, or in the first half of the said process, when it is intended to control the number and location of the chemically sensitized nuclei which are formed on the AgX grains. Reference can be made to the disclosures in Japanese Patent Application Nos. 62-319740, 63-223739 and 63-26979 for details. In this case, the pendant type dyes are adsorbed on both $Ag^+$ sites and $X^-$ sites on the grain surface and so there is an advantage in that, in comparison with the method in which chemical sensitization nuclei formation is controlled by the independant type addition of sensitizing dyes and antifoggants, it is possible to protect the grain surface more completely and to control chemically sensitized nuclei formation more completely. Hence, the pendant type dyes can be used to control the location and number of chemically sensitized nuclei which are formed, and they can also be used for spectral sensitization which is their primary purpose.

The pendant type dyes may be added individually, or they may be used in combination with sensitizing dyes and/or antifoggants. In the later case it is possible to use the optimum amounts and the optimum mixing ratios for the intended purpose of the individual emulsion and, in practice, the optimum amounts and the optimum mixing ratio can be determined by preparing AgX emulsion coated samples in which the amounts and mixing ratios are varied and subjecting these samples to sensitometric measurements. The mixing ratio in terms of the numbers of molecules of the pendant type dye: sensitizing dye: antifoggant is preferably from 1:0:0 to 1:7:7, and more preferably from 1:0:0 to 1:4:4. The total amount of the above mentioned additives (the pendant type dye+ sensitizing dye+antifoggant) added is preferably from 120% to 20%, and more preferably from 100% to 30%, of the amount required to provide saturated adsorption.

When used for color sensitization purposes, these additives are preferably mixed prior to addition from the viewpoint of preventing the formation of dye aggregates.

The pendant type dyes, sensitizing dyes and antifoggants may be dispersed directly in the AgX emulsion, or they may be added to the emulsion after dissolution in a solvent such as water, methanol, ethanol, propanol, methylcellosolve or 2,2,3-tetrafluoropropanol or in a mixture of such solvents. Furthermore, aqueous solutions obtained in the presence of acids or bases, as disclosed, for example, in JP-B-44-23389, JP-B-44-27555 and JP-B-57-22089, and aqueous solutions or colloidal dispersions obtained in the presence of a surfactant, as disclosed, for example, in U.S. Pat. No. 3,822,135 and U.S. Pat. No. 4,006,025, may also be added to the emulsion. Furthermore, a dispersion in water or hydrophilic colloid obtained after dissolution in a solvent which is essentially immiscible with water, such as phenoxyethanol, may be added to the emulsion. Direct dispersion in a hydrophilic colloid, as described in JP-A-53-102733 and JP-A-58-105141, can be carried out and the resulting dispersion product may be added to the emulsion.

Compounds known in the past as additives for AgX photosensitive materials can be used for the abovementioned spectrally sensitizing dyes and antifoggants, and reference can be made to the above mentioned disclosures and the disclosures made in the literature mentioned hereafter for details.

The antenna sensitizing dyes described, for example, in R. Steiger and J. F. Reber, *Photographic Science and Engineering*, Vol. 27, page 59 (1983) are known as examples of sensitizing dyes which are bound with other compounds which are used in the AgX photographic materials. In this case, a luminescent dye is chemically bonded with a dispersion medium such as gelatin and this is quite different from the pendant type dyes of this invention in which antifoggants and sensitizing dyes are chemically bound to each other with covalent bonds. Furthermore, the luminescent dyes are essentially not adsorbed on the AgX grains and they are quite different in this respect from the pendant type dyes of this invention which are essentially adsorbed. Here, the term "essentially" signifies at least 90% of the added dye.

The reduction potential of the dye can be cited as a distinguishing feature of the dyes which are preferred as pendant dyes in this invention. Dyes which have a reduction potential $E_R{}^0$ (V vs. S.C.E.) of less than $-1.15$ V, and preferably less than −1.25 V, are preferred on account of their good spectral sensitization efficiency. Reference can be made to the disclosure of Japanese Patent Application No. 63-78465 in connection with methods for the measurement of $E_R{}^0$.

The pendant type dyes of this invention are compounds in which at least sensitizing dyes and antifoggants are organochemically bonded together via their substituent groups or via a linking agent, but other compounds may also be bound. In such cases the other compounds are most preferable compounds which have been known hitherto as photographic additives. For example, one or more compounds from among the supersensitizers, latent image stabilizers, quaternary salt surfactants, reduction sensitizers, sulfur sensitizers, fogging agents, pressure desensitization preventors, developing agents and agents for improving photographic characteristics can be included. In such a case, the substances which have been adsorbed competitively with sensitizing dyes and antifoggants are adsorbed conjointly, and their action is more pronounced.

The use of super-sensitizers in this way is particularly preferred. In such cases, the bonding position is preferably on a substituent of the sensitizing dye, the antifoggant or the linking agent. Furthermore, a bonding position on a substituent of the sensitizing dye is most desirable in the case of a supersensitizer. This is because the sensitizing effect is realized more effectively when the super sensitizer is close to the sensitizing dye. Reference can be made to the disclosures in the literature mentioned hereinafter for specific examples of these compounds. Furthermore, reference can be made to the aforementioned bonding methods in connection with methods for the bonding of these compounds. Furthermore, these compounds (other pendant type dyes) may be used individually, or they may be used conjointly one or more of the aforementioned simple pendant type dyes in which just a sensitizing dye and an antifoggant have been bound organochemically, sensitizing dyes and antifoggants. The ratio (in terms of the numbers of molecules)[(other pendant type dye)+simple pendant type dye]: sensitizing dye : antifoggant in which these compounds can be used conjointly is within the range of from 1:0:0 to 1:7:7, and preferably within the range of from 1:0:0 to 1:4:4, and the ratio (in terms of the numbers of molecules) (other pendant type dye) pendant type dye is preferably within the range of from 1:0 to 0:1. The most desirable ratio can be determined by preparing samples with different additive ratios, according to the respective purpose of the photosensitive material, and testing the said photographic properties.

No particular limitation is imposed upon the additives which can be added from grain formation up to coating of the AgX emulsions of this invention. Examples of permissible additives include AgX solvents (also known as ripening accelerators), doping agents for AgX grains [for example, compounds of Group VIII precious metals and other metal (for example, gold, iron, lead and cadmium), chalcogen compounds and SCN compounds], dispersion media, antifoggants, stabilizers, sensitizing dyes (for blue, green, red, infrared, panchromatic and orthochromatic purposes for example), supersensitizers, chemical sensitizers (for example, chemical sensitizers obtained by the addition, either singly or in combination, of sulfur, selenium tellurium, gold and Group VIII precious metal compounds, and phosphorus compounds, and most preferably chemical sensitizers comprising a combination of gold, sulfur and selenium compounds, and reduction sensitizers such as stannous chloride, thiourea dioxide, polyamines and amineborane based compounds), fogging agents (organic fogging agents such as hydrazine-based compounds, and inorganic fogging agents), surfactants (anti-foaming agents etc.), emulsion precipitants, soluble silver salts (for example, AgSCN, silver phosphate and silver acetate), latent image stabilizers, pressure desensitization preventors, thickeners, film hardening agents, developers (for example, hydroquinone based compounds) and development modifiers, and reference can be made to the descriptions in the literature mentioned hereinafter for actual examples of compounds and methods of use. Furthermore, surfactants such as coating aids, film hardening agents, binders, materials for improving the characteristics of the photosensitive material (for example, plasticizers, antistatic agents, ultraviolet absorbers, light-scattering or absorbing materials, matting agents, sliding agents, fluorescent brighteners, dimensional stabilizers and adhesion preventors), agents for improving photographic characteristics (for example, developing accelerators such as polyethylene oxide and contrast increasing agents such as glutaraldehyde), halogen acceptors, and dyes are normally added after the completion of chemical sensitization and prior to the completion of coating, and these compounds can be added in accordance with the intended purpose. Reference can be made to the descriptions in the literature mentioned below in connection with actual examples of these compounds and methods for their use, and in connection with supports, microencapsulated supports, subbing layers, antihalation layers, surface protective layers, interlayers, layer structures in which two or more emulsion layers are arranged sequentially from high speed to low speed from the side on which the light is incident, overcoat layers on the reverse side for improving the characteristics of the reverse side of the support, simultaneous multilayer coating methods, drying methods, the use of hydrogen sensitization, reaction equipment and stirring equipment for AgX emulsion preparation, the ambient conditions during exposure (for example, temperature, pressure, humidity and gas type), methods of exposure (for example, pre-exposure, high-intensity exposure, low intensity exposure), the type of light source (for example, natural light or laser light), photographic processing agents and processing methods, auto-inhibiting type developers, pattial grain development, and waterless wash processing methods.

The AgX emulsions of this invention can be used in color photographic materials. Reference can be made to the descriptions in the literature mentioned hereinafter in this case in connection with details of the methods used to form the colored image, the layer structure, the use of color filters, colored image forming agents which can be used, colored image forming agents and non-colored image forming agents which release photographically useful fragments such as development inhibitors and development amplifying agents during color development, (for example, DIR couplers, super DIR couplers, DAR couplers and DTR compounds), and also DIR compounds which undergo oxidative cleavage, timing DIR couplers, weakly diffusible dye-forming couplers, polymeric couplers (for example, latex couplers), coloring dye-forming couplers and/or competitive couplers which form colored masks for color images, scavenger, bleaching and the omission of bleaching of the developed silver, image dye stabilizers, omission of the yellow filter layer, actual examples of compounds and methods of use.

Moreover, so-called combined structures with the known techniques described in the literature mentioned hereinafter can also be used.

Reference can be made to the disclosures made in the amendment attached to Japanese Patent Application No. 63-153722; *Research Disclosure* Vol. 176 (item 17643) (December, 1978); *Research Disclosure* Vol. 184 (item 18431) (August, 1979); *Research Disclosure* Vol. 216 (item 21728) (May, 1982); *Nikka Kyogetsu-ho* (Japanese Chemical Society Monthly Report) December 1984, pp. 18–27; H. Kosaka, *Nippon, Shashin Gakkai-shi* (Japanese Photographic Society Journal), Vol. 49, 7 (1987); U.S. Pat. Nos. 4,430,520, 4,433,048, 4,434,226, 4,797,354, 4,693,964, 4,678,745, 4,334,012, 4,713,321, JP-A-59-90842, JP A-62-6251, JP A-62-160449, JP-A-62-115035, JP-A-62-141112, JP-A-62-269958, JP-A-63-71838, JP-A-61-112141, JP-A-62-27731, JP-A-62 266538, JP-A-1-158425, JP-A-1-131541, JP-A-1-131547, JP-A-62-134640, Japanese Patent Application Nos. 63-84664, 62-319740, 62-263319, 61-634132, 61-034131, 63-129226, U.S. Pat. Nos. 4,705,744, 4,707,436, 4,728,602, 4,806,461, T. H. James, *The Theory of the Photographic Process*, Fourth Edition, Macmillan, New York, 1977, V. K. Zelikman et al., *Making and Coating Photographic Emulsion* (published by The Focal Press, 1964), P. Glafkides, *Chimie et Physigue Photographiques*, Fifth Edition, Edition de l'Usine Nouvelle, Paris, 1987, and ibid., Second Edition, Paul Montel, Paris, 1957 for details.

The silver halide emulsions of this invention can be used in black-and-white silver halide photographic materials [for example, X-ray sensitive materials, sensitive materials for printing purposes, printing papers, negative films, microfilms, direct positive materials, ultrafine grained dry plate materials (for use as LSI photomasks, and as masks for shadow purposes and liquid crystal purposes)], and in color photographic materials (for example, negative films, printing papers, reversal films, direct positive color materials and silver dye bleaching photosensitive materials). Furthermore, they can also be used in diffusion transfer photosensitive materials (for example, color diffusion transfer elements and silver salt diffusion transfer elements), heat developable photosensitive materials (black-and-white and color materials), high-density digital recording photosensitive materials and materials for use in holography.

The use of emulsions of this invention for the structural emulsions in Example 1 in JP A-62 269958, Examples 13 and 14 in JP-A-63 305343 and JP-A-63-151618, Example 9 in U.S. Patents 4,629,678 and 4,435,499, JP-A-62-253159 and JP-A-1-131541 and the examples in JP-A-62-266538, JP-A-1-131547, U.S. Pat. No. 4,806,461 and Japanese Patent Application No. 62-263319 is desirable.

EFFECT OF THE INVENTION

The AgX emulsions of this invention, which have at least a dispersion medium, a pendant type spectrally sensitizing dye and AgX grains, have as a distinguishing feature at least one of the four distinguishing features indicated below.

1. It is usually necessary to adsorb both sensitizing dyes and antifoggants on the AgX grains in AgX photographic emulsions, but the two types of compound are adsorbed competitively. For this reason, it has not been possible hitherto to select freely the sensitizing dyes and antifoggants which are preferred photographically. In the case of the pendant type dyes of this invention, the adsorption of the sensitizing dye portion and the adsorption of the antifoggant portion are compatible. Thus, even though one entity is strongly adsorbed, this will not cause the other which is adsorbed weakly to be desorbed but will rather function in such a way as to facilitate adsorption of the portion which is adsorbed weakly. The effect of increasing adsorption in such a case can be expressed quantitatively in the following way. Thus, by putting the rate of adsorption on the AgX grain surface of the molecule [proportional to the product of the collision frequency P of the molecule with the AgX grain surface and the proportion of the surface on which no adsorption has occurred, $(1-\theta)$, and represented by a $(1-\theta)P$, where a is the constant of proportion]equal to the rate of desorption [proportional to the product of the extent of adsorption of the molecules, $\theta$, and $\exp(-E/RT)$, and represented by $b\theta\exp(-E,RT)$, where b is the constant of proportion {E is the energy of adsorption per molecule}] in the steady state, the percentage adsorption can be expressed by the following equation:

$$\frac{\theta}{1-\theta} = \frac{aP}{b}\exp\left(\frac{E}{RT}\right) \tag{34}$$

Interaction between adsorbed molecules has been neglected in this case. Here, $\theta$ is the proportion of the surface on which adsorption has occurred. Hence, if the adsorption energy of the sensitizing dye portion is $E_1$ and the adsorption energy of the antifoggant portion is $E_2$, then $E=E_1+E_2$, and the percentage adsorption of the said pendant type dye, $[\theta/(1-\theta)]$, is increased by approximately $\exp(E_2/RT)$ times. This effect arises because the dye and the antifoggant are bound by a covalent bond. Furthermore, in those cases where the pendant type dye of this invention is comprised of a cationic cyanine dye and an anionic antifoggant, adsorption is also increased by a charge compensation effect. It is therefore possible to select freely the combination of sensitizing dye and antifoggant which is most desirable photographically and there is an advantage in that adsorption is improved. The improvement in adsorption of the said dye is especially great for AgX emulsions with a high Cl content. Furthermore, the dyes are adsorbed strongly in case where the iodide content of the grain surface is high, but antifoggants are weakly adsorbed in such cases and the antifoggant has an inadequate effect. In such cases, the pendant type dyes of this invention improve the adsorption of the antifoggant and have the effect of increasing the effectiveness of the antifoggant.

Many of the sensitizing dyes have an $-R-SO_3^-$ group in the molecule, as shown in formula (14-1), but this group hardly interacts with the $Ag^+$ sites on the grain surface at all and so the charge compensation effect mentioned above does not arise. This is because of an increase in the ion conductivity of the interstitial silver ions in the AgX grain when the said dye is adsorbed. Thus, the said charge compensation effect exists in the case of dyes of the type in formula (17-5).

2. Means for increasing the strength of adhesion have been used conventionally to increase adsorption. However, more development inhibition occurred when the strength of adsorption was increased, and improved adsorption of dye and antifoggant and a speeding-up the rate of development were mutually exclusive and could not both be achieved. The strength of adsorption at each adsorption site is not so strong with the pendant type dyes of this invention, but adsorption of the said dye, antifoggant and the useful additives for photographs described above is increased by the increased number of adsorption sites. Hence, the pendant type dyes enable adsorption to be improved without slowing down the rate of development.

The effects described in 1 above and 3 below are weak in the case of merocyanine dye—antifoggant type pendant type dyes, but these dyes are effective nevertheless because the effects due to the increase in the number of adsorption sites still arise.

3. The formation of cationic dye aggregates is prevented. This is because dye aggregates cannot form with the pendant type dyes because an antifoggant is always adsorbed adjacent to the sensitizing dye. Hence, AgX emulsions which have pendant type dyes of this invention will have the following advantages.

a. There is no increase in the space charge layer as described in the item (4)-a above, and the electron transmission efficiency from the sensitizing dye to the AgX layer is improved.

b. There is no dispersed latent image formation as described in the item (4)-b above, and the developable latent image formation efficiency is improved.

c. There is no electron trapping by cationic dye aggregates as described in the item (4) c above, and the latent image formation efficiency is improved.

d. There is no inhibition of development as described in the item (4)-d above, and the progress of development is improved.

e. There is no mixing of adsorption states as described in the item (5) above, and primarily single molecule adsorption occurs. The half-width of the said absorption spectrum band is therefore reduced, there is no pronounced spread into the other color-sensitive layer regions, and color photographs which have excellent color reproduction can be obtained.

A narrow half-width of the dye absorption spectrum is preferred. This is not a problem because when the said half-width is narrow with respect to the color-sensitive region, the width of the overall absorption spectrum can be adjusted freely by the conjoint use of several types of dye which have different peak absorption wavelengths. Indeed, it is possible to provide color images which have excellent sharpness and color reproduction since the ends of the absorption spectrum can have a steep gradient.

f. The rebonding of electrons and positive holes which is carried out in the dye aggregates is prevented because the formation of aggregates is prevented.

g. Generally, when the amount of the dye adsorbed is increased, the dye aggregate (H or J aggregate) is formed, and thereby the inherent desensitization is caused. However, in the case of the pendant type dye, the advantage in which the pendant type dye can be added until the saturated adsorption amount because the aggregate causing the desensitization is not formed is obtained.

4. When the pendant type dyes which include a cyanine dye are added prior to chemical sensitization ripening, or during the first half of the said process, and used for controlling the locations at which chemical sensitization nuclei are produced and the number of the said nuclei, there is an advantage in that the said pendant type dye is adsorbed on both the $Ag^+$ sites and the $X^-$ sites on the AgX grain surface so that the grain surface is protected more completely and the formation of chemical sensitization nuclei can be controlled more completely.

5. The sensitizing dye can be extremely function-separated in the molecular design.

Conventionally, the dye which is not used because the energy level characteristics of the absorbance index, the maximum occupancy orbit and the minimum vacancy orbit are remarkably improved but the adsorption characteristics of the dye to the silver halide grain are deteriorated can be used according to a method of the present invention. That is, the adsorption characteristics can be separately controlled in the molecular design of the adsorbing groups. In the embodiment in FIG. 1, the antifoggant functions as a substance in which the sensitizing dye is approached until the position which the electron can be transmitted on the surface of the silver halide grain by the overlap between the wave function of the minimum vacancy orbit of the sensitizing dye and the wave function of the silver halide conduction band on the surface of the silver halide grain. Also the embodiment in FIG. 1 has an advantage in which the distance between the sensitizing dye and the surface of the silver halide grain can be independently controlled.

Preferred embodiments of this invention are as follows.

1. In the AgX photosensitive materials of this invention, the dispersion medium is gelatin.

2. In the AgX photosensitive materials as described in the first embodiment, the pendant type dye is a compound in which at least a sensitizing dye and an antifoggant are organochemically bonded either directly between the substituent groups, or via a linking agent.

3. In the AgX photosensitive materials as described in the first embodiment, the pendant type dye is a compound in which a sensitizing dye and an antifoggant are organochemically bonded directly between the substituent groups, or via a linking group.

4. In the AgX photosensitive materials as described in the first and third embodiments, the pendant type dye is a compound represented by formula (6) or formula (7) of this specification, and l/n is from 2/1 to 1/4, and preferably from 2/1 to 1/2 (where for m equals l or n). n represents 0, 1, 2 and 3.

5. In the AgX photosensitive materials as described in embodiments 1 to 4, the sensitizing dyes from which the pendant type dyes are formed are cyanine dyes and merocyanine dyes.

6 In the AgX photosensitive materials as described in embodiments 1 to 5, the sensitizing dyes from which the pendant type dyes are formed are cyanine dyes.

7. In the AgX photosensitive materials as described in embodiments 1 to 6, the antifoggants from which the pendant type dyes are formed are compounds in the items (1), (2) and (3) of this specification.

8. In the AgX photosensitive materials as described in embodiments 1 to 7, the pendant type sensitizing dye comprises the sensitizing dyes and the antifoggants containing a saturated or unsaturated 5- to 7-membered ring having at least one nitrogen atom as a hetero atom.

9. In the AgX photosensitive materials as described in embodiments 1 to 7, the pendant type sensitizing dye comprises the sensitizing dye and the antifoggants having a structure represented by formula R—SH, R—S—R', R—SeH, R—Se—R', R—TeH or R—Te—R'.

10. In the AgX photosensitive materials as described in embodiments 1 to 7, the pendant type sensitizing dye comprises the sensitizing dye and the antifoggants containing a saturated or unsaturated 5- to 7-membered ring having at least one nitrogen atom as a hetero atom, and the antifoggants having a structure represented by formula R—SH, R—S—R', R—SeH, R—Se—R', R—TeH or R—Te—R'.

11. In the AgX photosensitive materials as described in embodiments 1 to 10, the pendant type sensitizing dye has a structure having the antifoggants at both ends of the dye molecule, and is a separated-function type dye in which the dye molecule is coercively adsorbed on the silver halide grains by adsorbing the antifoggants on the silver halide grains.

12. In the AgX photosensitive materials as described in embodiments 1 to 8, pKsp of the antifoggants from which the pendant type dye is formed is such that [pKsp of the antifoggant—pKsp of the substrate surface AgX] has a value of from −2 to 3.5 and preferably of from −1.5 to 2.5.

13. In the AgX photosensitive materials as described in embodiments 1 to 12, the AgX photosensitive materials contain at least the pendant type dyes, sensitizing dyes and antifoggants, and the ratio, in terms of the numbers of molecules, pendant type dye sensitizing dye antifoggant is from 1:0:0 to 1:7:7, and preferably from 1:0:0 to 1:4:4.

14. In the AgX photosensitive materials as described in embodiments 1 to 13, the pendant type dye is a simple pendant type dye comprised of sensitizing dye and antifoggant, and at least one of photographic additives (such as super-sensitizer, latent image stabilizer, reduction sensitizer, sulfur sensitizer, fogging agent, pressure desensitization preventor, developing agent, or an agent for improving photographic characteristics), and the ratio, in terms of the numbers of molecules, of pendant type dye photographic additives is from 1:0 to 0:1.

15. In the AgX photosensitive materials as described in embodiments 1 to 14, the photographic additives are comprised of sensitizing dyes, antifoggants and super-sensitizers which are organochemically bonded directly between the substituent group, or via linking agents.

16. In the AgX photosensitive materials as described in embodiments 1 to 15, at least 60%, and preferably at least 70%, of the total projected surface area of the AgX grains is accounted for by AgX grains in which at least 60%, and preferably at least 70%, of the grain surface has a $Cl^-$ content ≧40 mol% and preferably ≧70 mol %.

17. In the AgX photosensitive materials as described in embodiments 1 to 16, at least 70%, preferably at least 90%, of the total projected surface area of the said AgX grains is accounted for by tabular AgX grains which have an aspect ratio of at least 2, and preferably of from 4 to 20.

18. In the AgX photosensitive materials as described in embodiments 1 to 16, at least 70%, and preferably at least 90%, and most desirably at least 95%, of the total projected surface area of the AgX grains is accounted for by tabular AgX grains which have 2 twinned crystal planes parallel to the principle plane, the grain size distribution of the said tabular AgX grains expressed as a variation coefficient (C.V.) is not more than 30%, preferably not more than 20%, and most desirably not more than 15%, and the aspect ratio is at least 2, and preferably from 4 to 20.

EXAMPLES

The invention is described in practical term by means of examples below, but the embodiments of the invention are not limited by these examples.

EXAMPLE 1

The AgCl emulsion of Example 9 in Japanese Patent Application No. 63-223739 was prepared (the pH during grain formation was set to 4.5 however), washed with water and redispersed, the system was adjusted to pH 5.4, pCl 1.8, and a sulfur sensitizer (allylthiourea) was added at 50° C. and ripening was carried out for 20 minutes, after which the temperature was adjusted to 45° C., 75% of the amount of the pendant type dye (17-5) required to provide saturation adsorption was added and the mixture was stirred for a further 30 minutes.

COMPARATIVE EXAMPLE 1

Both the dye (14-6) and the antifoggant (35) were added to the same emulsion as in Example 1 at 45° C. in molar amounts equal to those of the pendant type dye of Example 1 instead of the pendant type dye used in Example 1, stirring was continued for 30 minutes.

A gelatin-degrading enzyme (actinase) was added to the emulsions of Example 1 and Comparative Example 1, respectively, the gelatin was decomposed, the AgX grains were precipitated out, and the absorption spectra in the visible region of the supernatant liquids were measured. The dye concentration in each supernatant liquid was determined by comparing the said absorption spectrum intensity against a calibration curve (absorption spectrum intensity vs known dye concentration), and the proportion adsorbed on the AgX grains was determined. More than 99% of the added dye was adsorbed with the emulsion of Example 1, but only 50% of dye and antifoggant was adsorbed with the emulsion of Comparative Example 1, and the effect of this invention was confirmed.

Furthermore, a coating promoter was added to the emulsions of Example 1 and Comparative Example 1 and the emulsions were coated onto a TAC base (coated silver weight 1.5 g/m$^2$) and dried, after which they were subjected to a 1 second wedge exposure was carried out using -blue light (light of wavelength of 500 nm and above) and developed for 4 minutes at 20° C. using MAA-lCl development bath (an MAA-1 development bath in which the KBr had been replaced by 0.58 g/l of NaCl). Upon comparing the relative speeds (expressed by the reciprocal of the exposure in lux/sec for a density of fog+0.2), a value of 48 was obtained for the emulsion of Comparative Example 1 against a value of 100 the emulsion of Example 1, and the effect of the invention was confirmed.

EXAMPLE 2

An aqueous gelatin solution (990 ml of water, 40 grams of gelatin, 0.2 gram of KBr, pH 6.0) was introduced into a reaction vessel, the temperature raised to 75° C. and an aqueous $AgNO_3$ solution and an aqueous KBr solution were added simultaneously with stirring over a period of 10 minutes at delivery rate of 4 ml/minute (corresponding to $AgNO_3$ 0.028 g/min.) using precision fixed flow rate pumps, after which a further simultaneous addition was carried out for 7 minutes at a flow rate of 28 ml/minute (corresponding to $AgNO_3$ 0.196 g/min.). The pBr value was constant during the addition. The pBr value was then adjusted to 1.77 and an aqueous $AgNO_3$ solution and an aqueous KBr solution of 20 times the previous concentration were added simultaneously at initial flow rates of 3 ml/minute and final flow rates of 27 ml/minute, using a linear flow rate accelerating procedure, over a period of 42 minutes while maintaining a constant pBr value. After this an aqueous $AgNO_3$ solution and an aqueous KBr solution of twice this concentration were added simultaneously at initial flow rates of 12 ml/minute and final flow rates of 16.4 ml/minute, using a linear flow rate accelerating procedure, over a period of 22 minutes while maintaining a constant pBr value. The temperature was lowered to 30° C., the emulsion was washed and redispersed at 40° C. and the system was adjusted to pH 6.4, pBr 3.0. The diameter of the octahedral AgBr emulsion grains so obtained was 0.98 μm. Here, the grain diameter is the diameter of a circle having the same surface area as the projected surface area of the grain when the replica image of the grain is observed under an electron microscope.

The temperature of the emulsion was lowered to 55° C. and $2\times10^{-5}$ mol/mol·AgBr of $Na_2S_2O_3\cdot5H_2O$ was added, followed 5 minutes later by the addition of $7\times10^{-6}$ mol/mol·AgBr of a gold sensitizer (a mixture of $HAuCl_4$ and NaSCN), and ripening was carried out for 50 minutes, after which the temperature was lowered to 40° C., the pendant type dye (17-5) was added in an amount equal to 80% of the saturated adsorption and the mixture was stirred for a period of 20 minutes.

COMPARATIVE EXAMPLE 2

Both the dye (14-6) and the antifoggant (35) were added to the same emulsion as in Example 2 in molar amounts equal to those of the pendant type dye of Example 2 instead of the pendant type dye, and stirring was continued for 20 minutes.

A coating promotor and $2\times10^{-3}$ mol/mol·AgBr of compound (35) were added to the emulsions of Example 2 and Comparative Example 2 and the emulsions were coated onto a TAC base (coated silver weight 1.5 g/m$^2$) dried, subjected to a 1 second wedge exposure with -blue light (light with a wavelength of 500 nm and above) and developed for 10 minutes at 20° C. using MAA-1 development bath. On comparing the relative speeds, a value of 85 as obtained for the emulsion of Comparative Example 2 against a value of 100 for the emulsion of Example 2, and the effect of this invention was confirmed.

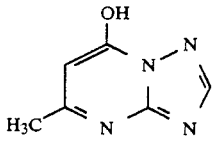

(35)

EXAMPLE 3

An aqueous gelatin solution (containing 1 liter of water, 7 grams of enzyme decomposed gelatin of average molecular weight M 20,000, 4.5 grams of KBr, pH 6) was introduced into a reaction vessel, and 27.5 ml of an aqueous $AgNO_3$ solution (containing 32 grams of $AgNO_3$, 0.7 grams of gelatin of M 20,000 and 0.17 ml of IN $HNO_3$ solution per 100 ml) and an aqueous KBr solution (containing 23.3 grams of KBr and 0.7 gram of gelatin of M 20,000 per 100 ml) were added with stirring at 30° C. using the double jet method at flow rates of 25 ml/minute. After stirring for 1 minute, 550 ml of an aqueous gelatin solution (containing 32 g of an alkali-treated photographic gelatin of M 100,000) was added and, after stirring for 3 minutes, the temperature was raised to 75° C. After ripening for 12 minutes, an $AgNO_3$ solution (containing 3.2 g of $AgNO_3$) was added over a period of 3 minutes and then 10 ml of $NH_4NO_3$ (50 wt % solution) and 10 ml of $NH_3$ (a 25 wt % solution) were added and the mixture was ripened for 30 minutes. The pH was adjusted to 6 by adding $HNO_3$ and a KBr solution (containing 1.6 g of KBr) was added, and then an $AgNO_3$ solution (containing 15 g of $AgNO_3$ per 100 ml) and a KBr solution (containing 11 g of KBr per 100 ml) were added by the controlled double jet method at a silver potential of −20 mV (vs. S.C.E.). The rate of addition of the $AgNO_3$ solution was 8 ml/minute during the first 10 minutes and 15 ml/minute during the following 20 minutes. The silver potential was then set at 0 mV and an $AgNO_3$ solution of the same concentration and an aqueous halide solution (containing 10.34 g of KBr and 1.56 g of KI per 100 ml) were added by controlled double jet method (silver potential 0 mV) using a linear flow rate accelerating procedure with an initial flow rate of 15 ml/minute and a final flow rate of 21 ml/minute over a period of 30 minutes. Furthermore, the silver potential was then adjusted to −20 mV, and an $AgNO_3$ solution of the same co Centration and a KBr solution (containing 11 g of KBr per 100 ml) were added by controlled double jet method (silver potential −20 mV) over 3 minutes at flow rates of 30 ml/min. The temperature was lowered to 30° C., the emulsion was washed and redispersed at 40° C. and the system was adjusted to pH 6.4, pBr 3.0. The characteristics of the tabular grains so obtained were as follows.

Tabular grain diameter 1.6 μm, tabular aspect ratio 7.8, grain diameter variation coefficient 11%, projected surface area ratio of hexagonal tabular grains at least 99%.

The temperature of the emulsion was raised to 55° C. and $4\times10^{-5}$ mol/mol·AgBr of $Na_2S_2O_3\cdot5H_2O$ was added, followed 5 minutes later by the addition of $1\times10^{-5}$ mol/mol·AgBr of a gold sensitizer (a mixture of $HAuCl_4$ and NaSCN), and the mixture was ripened for 50 minutes, after which the temperature was lowered to 40° C. and a 1:1 (in terms of the numbers of molecules) mixed solution of pendant type dye (17-5) and the sensitizing dye (14-6) was added in an amount equal to 80% of the saturated adsorption and the stirring was continued for 20 minutes.

COMPARATIVE EXAMPLE 3

Both the dye (14-6) and the antifoggant (35) were added to the same emulsion as in Example 3 in molar amounts equal to those of the pendant type dye of Example 3 instead of the pendant type dye, and stirring was continued for 20 minutes.

A coating promotor and $2\times10^{-3}$ mol/mol·AgBr of compound (35) were added to the emulsions of Example 3 and Comparative Example 3 and the emulsions were coated onto a TAC base (coated silver weight 1.5 g/m$^2$) dried and then subjected to a 1 second wedge exposure with -blue light (light with a wavelength of 500 nm and above) and developed for 10 minutes at 20° C. using an MAA-1 development bath. Upon comparing the relative speeds a value of 80 was obtained for the emulsion of Comparative Example 3 against a value of 100 for the emulsion of Example 3, and the effect of sections 1-3 of the advantages of the invention was confirmed.

EXAMPLE 4

The emulsion which was prepared in Example 1 was chemically sensitized and then raised to 45° C. The pendant type dye represented by formula (36) was added with 85% of the saturated adsorption amount to the resulting emulsion, and then stirred for 20 minutes.

The resulting emulsion was raised to 40° C., and the coating aid is added to the emulsion. The thus-obtained emulsion was coated on a TAC base in a silver coating amount of 1.5 g/m$^2$ and dried. The obtained sample was subjected to a 1 second wedge exposure using -blue light (light of wavelength of 500 nm or more) and developed for 6 minutes at 20° C. using the MMA-lCl development bath described above.

Next, the relative speed was measured against the value of the emulsion of Example 1 (as 100). The obtained relative speed was 110.

Thus, the effect of the embodiment in FIG. 1 was established.

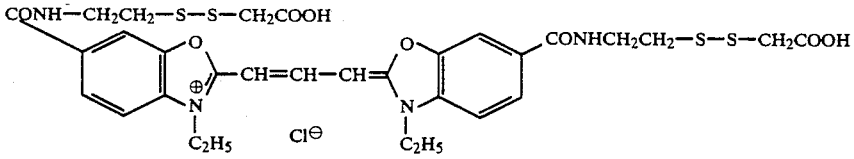

(36)

EXAMPLE 5

The same procedure as in Example 4 was carried out except that the pendant type dye represented by formula (37) was used instead of the pendant type dye represented by formula (36). The obtained relative speed was 112. Thus, the effect of the present invention was established.

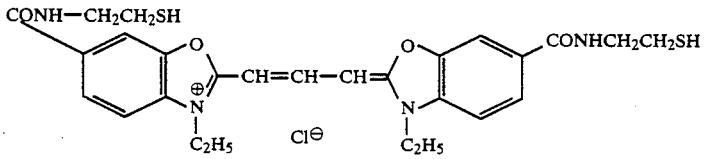

(37)

EXAMPLE 6

The same procedure as in Example 4 was carried out except that the pendant type dye represented by formula (38) was used in stead of the pendant type dye represented by formula (36). The obtained relative speed was 112. Thus, the effect of the present invention was established.

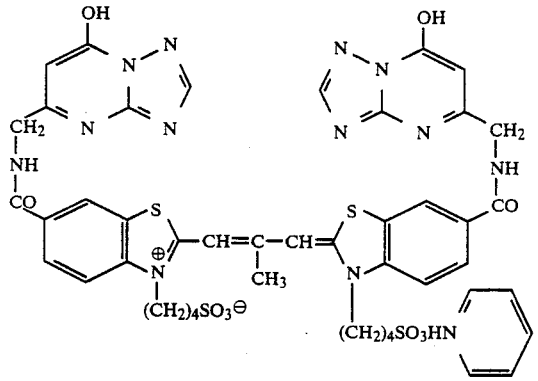

(38)

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon an emulsion layer comprising a dispersion medium, silver halide grains, and a pendant type sensitizing dye, wherein said pendant type sensitizing dye is a compound comprising a sensitizing dye and an antifoggant, each of which may have substituent groups and wherein said sensitizing dye and antifoggant are organochemically bonded.

2. The silver halide photographic materials as in claim 1, wherein said sensitizing dye and antifoggant are directly bonded via substituent groups or bonded via a linking group.

3. The silver halide photographic materials as in claim 2, wherein said linking group is a divalent linking group comprising not more than 20 carbon atoms and is selected from the group consisting of alkylene, arylene, alkenylene, —$SO_2$, —SO—, —O—, —S—, —(CO)— and —(NR)—, wherein R represents an alkyl group, an aryl group or a hydrogen atom.

4. The silver halide photographic materials as in claim 1, wherein said substituent groups are selected from the group consisting of hydroxyl groups, halogen atoms, lower alkyl groups and substituted alkyl groups, aryl groups and substituted aryl groups, lower alkoxy groups and substituted alkoxy groups, aryloxy groups, lower alkylthio groups, arylthio groups, methylenedioxy groups, cyano groups, amino groups and substituted amino groups, carboxyl groups, alkoxy-carbonyl groups, and acyl groups.

5. The silver halide photographic materials as in claim 1, wherein said pendant type dye is a compound represented by formula (6) or formula (7):

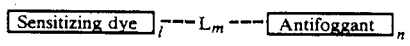

(6)

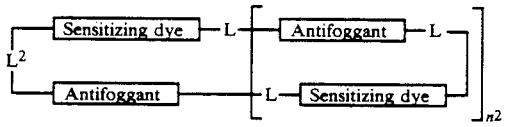

(7)

wherein 1/n is from 2/1 to 1/4, and m equals 1 or n. L and $L^2$ represent a divalent linking group having not more than 20 carbon atoms.

6. The silver halide photographic materials as in claim 1, wherein the sensitizing dyes from which said pendant type dyes are formed are selected from the group consisting of cyanine dyes and merocyanine dyes.

7. The silver halide photographic materials as in claim 1, wherein the antifoggants from which said pendant type dyes are formed are compounds represented by formula (4-1) or formula (4-2):

Z—Y (4—1)

Z—S—S—Y (4—2)

wherein Z represents selected from the group consisting of an azole ring, a pyrimidine ring, a triazine ring, a pyridine ring or an azaindene ring and Y is selected from the group consisting of hydrogen atom, substituted or unsubstituted alkyl groups, alkenyl groups, aryl groups, heterocyclic residual groups, halogen atoms, mercapto groups, cyano groups, carboxyl groups, sulfo groups, hydroxyl groups, nitro groups, alkoxy groups, aryloxy groups, acyl groups, acylamino groups, substituted amino groups, alkylthio or arylthio groups, alkoxycarbonyl groups or aryloxycarbonyl groups.

8. The silver halide photographic materials as in claim 1, wherein the antifoggants from which said pendant type dyes are formed are azaindenes, azoles or azoles which have a mercapto group.

9. The silver halide photographic materials as in claim 1, wherein pKsp of the antifoggant from which said pendant type dye is formed is such that (pKsp of the antifoggant—pKsp of the substrate surface AgX) has a value of from −2 to 3.5.

10. The silver halide photographic materials as in claim 1, which comprises sensitizing dyes and antifoggants other than said pendant type dyes, and wherein the ratio, in terms of the numbers of molecules of said pendant type dye : sensitizing dye : antifoggant is from 1:0:0 to 1:7:7.

11. The silver halide photographic materials as in claim 1, wherein at least 60% of the total projected surface area of said silver halide grains is accounted for by silver halide grains in which at least 60% of said grain surface has a Cl-content of 40 mol % or more.

12. The silver halide photographic materials as in claim 1, wherein at least 70% of the total projected surface area of said silver halide grains is accounted for by tabular silver halide grains which have an aspect ratio of at least 2.

13. The silver halide photographic materials as in claim 1, wherein said antifoggant is a compound containing a saturated or unsaturated 5- to 7-membered ring containing at least one nitrogen atom as a hetero atom.

14. The silver halide photographic materials as in claim 1, wherein said antifoggant is a compound containing a saturate or unsaturated 5- to 7-membered ring containing at least one nitrogen atom as a hetero atom, and a compound represented by formulae R—SH, R—S—R', R—SeH, R13 Se—R', R—TeH or T—Te—R', wherein R and R' each represents a substituted or unsubstituted alkyl group or a substituted or unsubstituted aryl group.

15. The silver halide photographic materials as in claim 1, wherein said pendant type sensitizing dye has a structure having said antifoggants at both ends of the dye molecule, and is a separated-function type dye in which the dye molecule is coercively adsorbed on the silver halide grains by adsorbing said antifoggants on the silver halide grains.

* * * * *